US005824444A

United States Patent [19]

Kinoshita et al.

[11] Patent Number: 5,824,444

[45] **Date of Patent: *Oct. 20, 1998**

[54] IMAGE FORMING APPARATUS

[75] Inventors: Akira Kinoshita, Hino; Katsumi Matsuura, Hachioji, both of Japan

[73] Assignee: Konica Corporation, Tokyo, Japan

[ * ] Notice: The term of this patent shall not extend beyond the expiration date of Pat. No. 5,660,960.

[21] Appl. No.: 855,036

[22] Filed: May 13, 1997

Related U.S. Application Data

[62] Division of Ser. No. 533,525, Sep. 25, 1995, Pat. No. 5,660,960.

[30] Foreign Application Priority Data

Sep. 29, 1994 [JP] Japan ..... 6-235476

[51] Int. Cl.[6] ..... G03G 15/02

[52] U.S. Cl. ..... 430/59; 430/54; 430/56; 399/159

[58] Field of Search ..... 430/54, 56, 59; 399/159

[56] References Cited

U.S. PATENT DOCUMENTS

| | | | |
|---|---|---|---|
| 3,997,342 | 12/1976 | Bailey | 430/59 |
| 4,587,189 | 5/1986 | Hor et al. | 430/59 |
| 5,087,544 | 2/1992 | Muto et al. | 430/59 |
| 5,166,023 | 11/1992 | Harada et al. | 430/62 |
| 5,427,879 | 6/1995 | Takano et al. | 430/59 |
| 5,521,042 | 5/1996 | Matsushima et al. | 430/59 |
| 5,660,960 | 8/1997 | Kinoshita et al. | 430/54 |

FOREIGN PATENT DOCUMENTS

| | | |
|---|---|---|
| 0 369 721 A2 | 5/1990 | European Pat. Off. . |
| 0 390 195 A1 | 10/1990 | European Pat. Off. . |
| 0 608 562 A1 | 8/1994 | European Pat. Off. . |
| 42 21 599 A1 | 1/1993 | Germany . |

*Primary Examiner*—Mark Chapman
*Attorney, Agent, or Firm*—Frishauf, Holtz, Goodman, Langer & Chick, P.C.

[57] ABSTRACT

An image forming apparatus comprising (a) a photoreceptor comprising an endless transparent support having thereon a transparent conductive layer, a charge carrier generation layer and a charge carrier transport layer; (b) a charger for charging uniformly the outermost surface of the photoreceptor; (c) an exposing means for having the photoreceptor exposed to light from the side of the support to form an electrostatic latent image on the surface of the photoreceptor; (d) a developing means for developing the electrostatic latent image to form a toner image; (e) a transfer means for transferring the toner image onto a transfer material; and (f) a fixing means for fixing the toner image transferred, wherein a transmittance of the charge carrier generation layer is 20% or less with respect to exposing light emitted from the exposing means, and a carrier drift mobility in the charge carrier transport layer is $1\times10^{-6}$ $cm^2$/V.sec or more under an electric field intensity of $2\times10^5$ V/cm.

16 Claims, 4 Drawing Sheets

IMAGE FORMING APPARATUS

This is a division of application Ser. No. 08/533,525 filed Sep. 25 1995, now U.S. Pat. No. 5,660,960 issued Aug. 26, 1997.

FIELD OF THE INVENTION

The present invention relates to an image forming apparatus of forming a color image with an electrophotographic photoreceptor having a photoconductive layer on a transparent support body.

BACKGROUND OF THE INVENTION

Conventionally, based on the Carlson method a color image is formed in a plurality of cycles. According to the Carlson method, a color image is formed as disclosed in Japanese Patent Publication Open to Public Inspection No. 27560/1986 (referred to as Official Gazette 1 in this specification), which will be described below. The photoreceptor drum is composed of a drum made of aluminum, on which a photoconductive layer is provided. Around the photoreceptor drum, there are provided a single charger, a single exposing unit and a plurality of developing units. When the photoreceptor drum is rotated by a plurality of times, a plurality of color toner images are superimposed on the photoconductive layer. Then the superimposed color image is transferred onto a transfer sheet by one operation. Next, the transferred image is fixed onto the transfer sheet. In this way, the color toner image is formed.

According to the image forming apparatus described in Official Gazette 1, the toner image of each color can be superimposed with high accuracy, so that the occurrence of color doubling can be advantageously avoided. However, it is necessary to rotate the photoreceptor drum by a plurality of times for image formation. Accordingly, the image forming speed is low and the working efficiency can not be enhanced.

When a plurality of toner images of different colors are superimposed on the photoreceptor drum, image exposure is blocked by a previously formed color image. Therefore, the image color reproduction is deteriorated.

Further, according to the image forming apparatus described in Official Gazette 1, the circumferential length of the photoreceptor drum must be longer than the length of the transfer sheet. For example, when a transfer sheet of size A3 is used, the diameter of the photoreceptor drum must be 180 to 200 mm. Therefore, dimensions of the apparatus are increased.

For example in Japanese Patent Publication Open to Public Inspection No. 307307/1993 (referred to as Official Gazette 2 in this specification), the following technique is disclosed. The photoreceptor drum is composed of a transparent cylindrical support on which a photoconductive layer is provided through a transparent conductive layer. Outside the photoreceptor drum, there are provided a plurality of chargers and developing units. Inside the photoreceptor drum, there are provided a plurality of LED exposure units. A color image is formed on the photoreceptor drum by one cycle operation.

According to Official Gazette 2 described above, the diameter of the photoreceptor drum can be made 60 to 160 mm. Therefore, the dimensions of the image forming apparatus can be reduced and also the weight thereof can be reduced. Further, the image forming process can be simplified. As a result, it becomes possible to form a color image at high speed.

However, recently, in the field of electrophotography, there is an increasing demand for a small-sized, light weight and highly durable image forming apparatus capable of forming an image of high quality. In the case of a color image forming apparatus, the color reproduction must be high, and further it is required that the color balance is excellent.

According to the method disclosed in Official Gazette 2, color image formation can be accomplished by one-cycle operation. Therefore, processes of charging, exposing and developing are continuously conducted in a short period of time. For this reason, the dynamic sensitivity of the photoreceptor must be high, and further it is important that the charging rises quickly.

When the charging onto the photoreceptor surface dose not rise quickly, even in a charging process in which a sufficiently high charging potential ought to be obtained, the predetermined surface potential can not be provided by the start of image exposure, and even in the process of image exposure, the electric potential of the photoreceptor gradually rises. As a result, it is difficult to form a clear image of high density. When the dynamic sensitivity of the photoreceptor is low, an electrostatic latent image formation can not be completed by the start of development after exposure. Accordingly, in the image formation process, the residual potential and image are increased. As a result, the image quality and color reproduction are low. Therefore, it is impossible to form a clear color image of high quality.

As described above, when the color image forming apparatus described in Official Gazette 2 is put into practical use, various problems may be encountered. Therefore, it is very important to improve the characteristic of the photoreceptor to be used.

However, in Official Gazette 2, there are no descriptions of the photoreceptor suitable for the color image formation conducted in one-cycle operation.

SUMMARY OF THE INVENTION

In view of the above circumstances, the present invention has been accomplished. An object of the present invention is to provide a color image forming apparatus in which the dynamic sensitivity of a photoreceptor is high and the charging rises quickly so that the occurrence of a residual potential and residual image can be prevented, and it becomes feasible to form an image excellent in color reproduction and color balance.

Another object of the present invention is to provide an image forming apparatus for forming an image of high quality and durability, having a small-size, light weight and high-speed.

The inventors have made extensive investigations in earnest and found the following. In order to prevent the environmental pollution, it is not appropriate to use an inorganic photoreceptor such as selenium or cadmium sulfide. Especially in the image forming apparatus of the present invention in which a highly sensitive photoreceptor is used and various optical properties such as transparency is required, it is preferable to use an organic photoreceptor.

According to the technical trends of organic photoreceptors, from the viewpoints of charge generation and charge transport functions, and also from the viewpoint of manufacture, photoreceptors of the lamination type are commonly used.

However, when the lamination type organic photoreceptor is used, it is difficult to provide the above electric charge rising characteristic and the electric charge falling characteristic in which the electric charge is quickly decreased by image exposure. The present inventors gave consideration to the above facts and made investigations into a relation of the charge moving speed on the photoreceptive layer (particularly, charge transport layer) charge with the electric charge rising characteristic and also with the charge remaining characteristic. As a result thereof, the present invention has been accomplished.

The above object can be accomplished by an image forming apparatus comprising:

(a) a photoreceptor comprising an endless transparent support provided thereon a transparent conductive layer, a charge carrier generation layer and a charge carrier transport layer in this order, wherein a transmittance of said charge carrier generation layer is 20% or less with respect to exposing light emitted from an exposing means and a carrier drift mobility of said charge carrier transport layer is $1\times10^{-6}$ $cm^2/V.sec$ or more under an electric field intensity of $2\times10^5$ V/cm, (b) a charger for charging an outermost surface of said photoreceptor;

(c) said exposing means for exposing the photoreceptor to light from the side of the support to form an electrostatic latent image on the surface of the photoreceptor, which is outermost from the support;

(d) a developing means for developing the electrostatic latent image to form a toner image;

(e) a transfer means for transferring the toner image onto a transfer material; and (f) a fixing means for fixing the toner image transferred onto the transfer material.

DETAILED DESCRIPTION OF THE INVENTION

Figure 1:
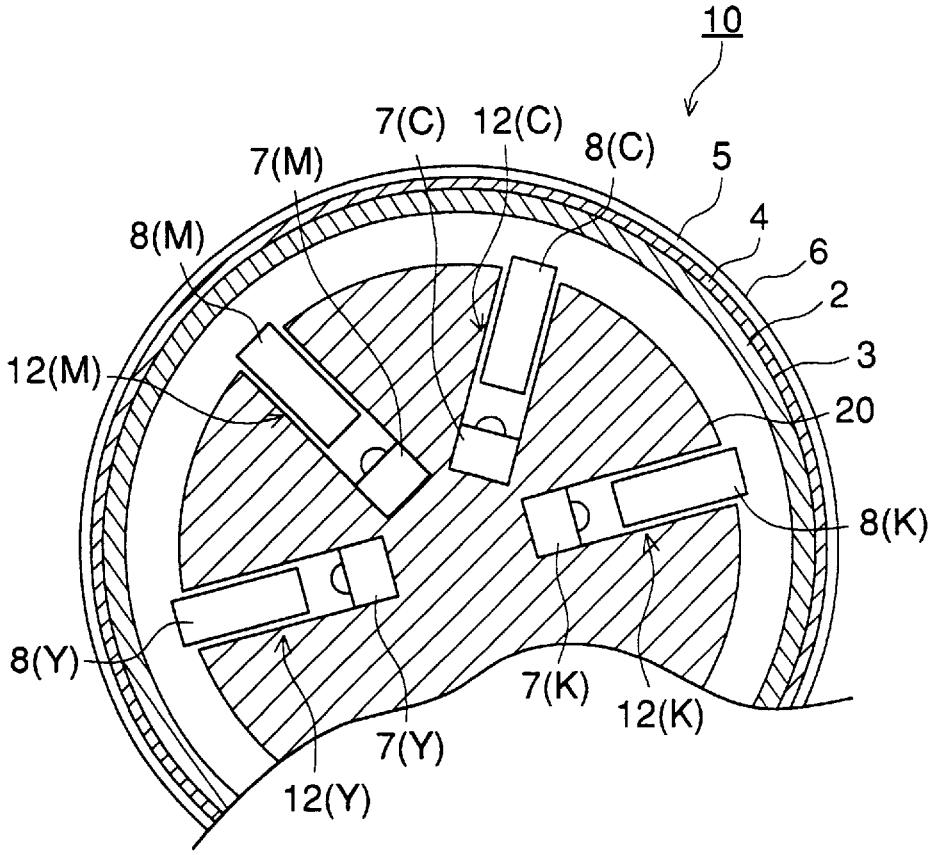
FIG. 1 is a cross-sectional view of the cylindrical photoreceptor.

In the present invention, the carrier transport layer preferably contains a carrier transport material represented by the following formula I.

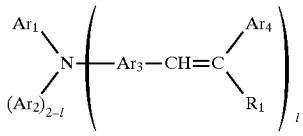

Formula I

In the above formula, $Ar_1$, $Ar_2$, $Ar_3$ and $Ar_4$ represent a substituted or unsubstituted aromatic hydrocarbon group or heterocyclic group. $R_2$ represents a hydrogen atom or a substituted or unsubstituted aromatic hydrocarbon group or heterocyclic group. In this case, l denotes 1 or 2. Examples of preferable aromatic hydrocarbon groups or heterocyclic groups are benzene, naphthalene, anthracene, thiophene, pyridine and carbazole. More preferable are benzene and naphthalene. Examples of the substituents on the aromatic hydrocarbon groups or heterocyclic groups are alkyl, aryl, alkoxy, aryoxy, acyl, acyloxy, halogen, amino, and cyano group. Preferably are an alkyl group having 1 to 6 carbon atoms, an alkoxy group having 1 to 6 carbon atoms, and an acyl having 1 to 6 carbon atoms, a halogen atom and an amino group. $Ar_4$ and $R_1$ may be combined with each other.

Examples of the typical chemical compounds represented by the formula I are described as follows.

Formula I

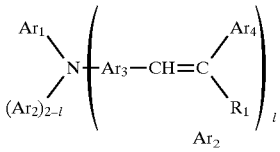

| | $Ar_1$ | $Ar_2$ | $Ar_3$ |
|---|---|---|---|
| B-1 | 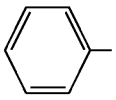 | 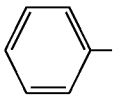 | 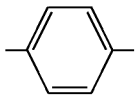 |
| B-2 | 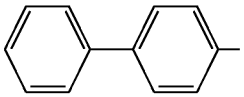 | 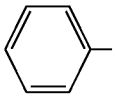 | 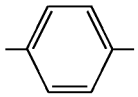 |
| B-3 | 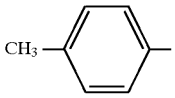 | 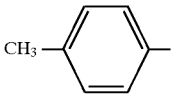 | 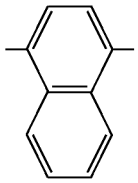 |

-continued
| | | | |
|---|---|---|---|
| B-4 | 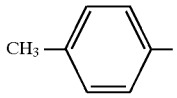 | 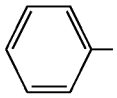 | 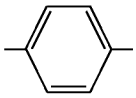 |
| B-5 | 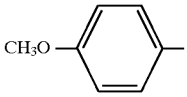 | 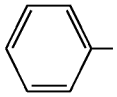 | 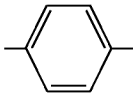 |
| B-6 | 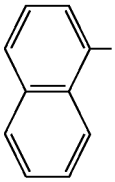 | 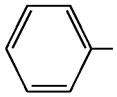 | 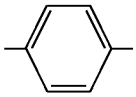 |
| B-7 | 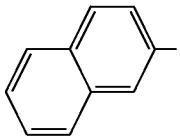 | 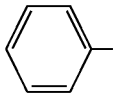 | 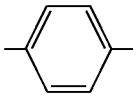 |
| B-8 | 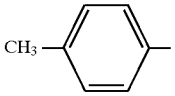 | 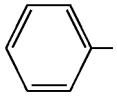 | 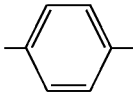 |
| B-9 | 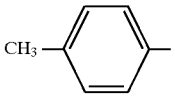 | 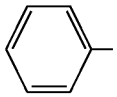 | 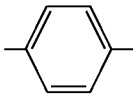 |
| B-10 | 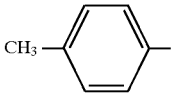 | 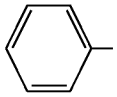 | 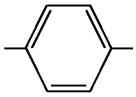 |
| B-11 | 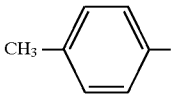 | 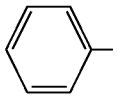 | 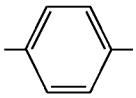 |
| B-12 | 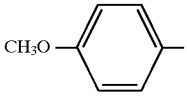 | 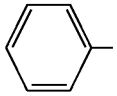 | 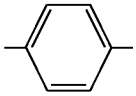 |
| B-13 | 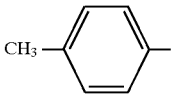 | 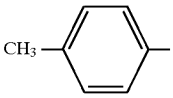 | 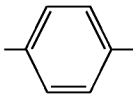 |
| B-14 | 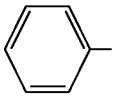 | 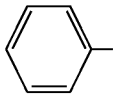 | 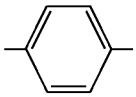 |
| B-15 | 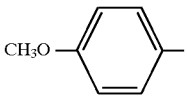 | 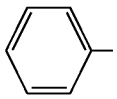 | 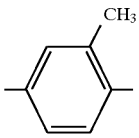 |
| B-16 | 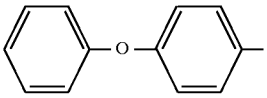 | 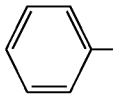 | 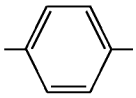 |

-continued
| | | | |
|---|---|---|---|
| B-17 | 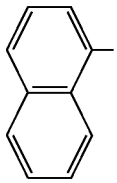 | 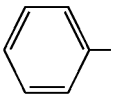 | 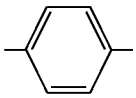 |
| B-18 | 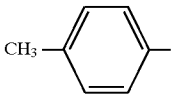 | 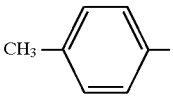 | 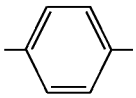 |
| B-19 | 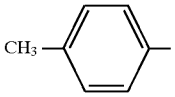 | 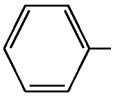 | 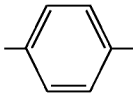 |
| B-20 | 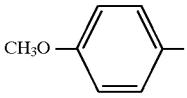 | 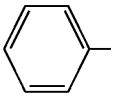 | 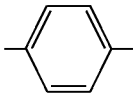 |
| B-21 | 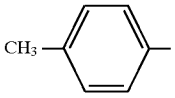 | 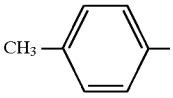 | 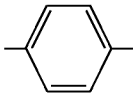 |
| B-22 | 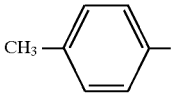 | 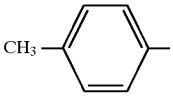 | 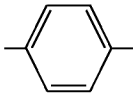 |
| B-23 | 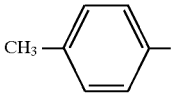 | 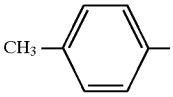 | 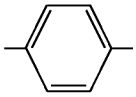 |
| B-24 | 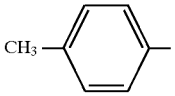 | 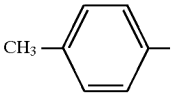 | 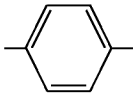 |
| B-25 | 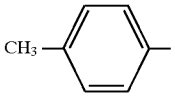 | 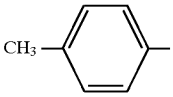 | 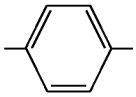 |
| B-26 | 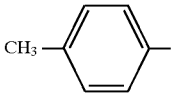 | 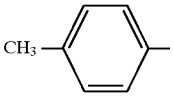 | 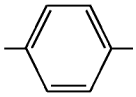 |
| B-27 | 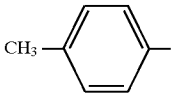 | 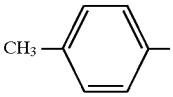 | 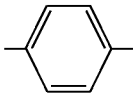 |
| B-28 | 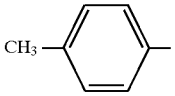 | 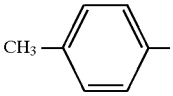 | 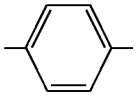 |
| B-29 | 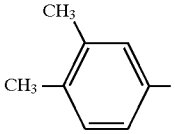 | 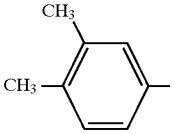 | 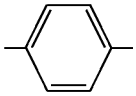 |

-continued
| | | | |
|---|---|---|---|
| B-30 | 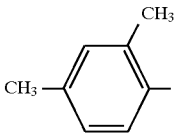 | 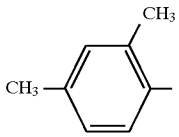 | 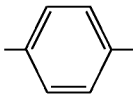 |
| B-31 | 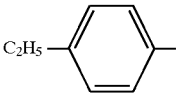 | 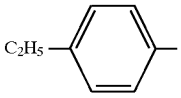 | 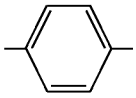 |
| B-32 | 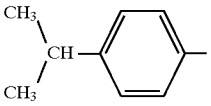 | 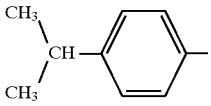 | 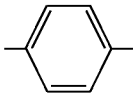 |
| B-33 | 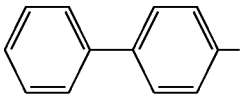 | 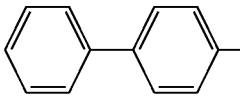 | 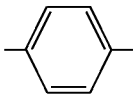 |
| B-34 | 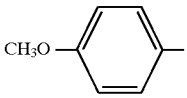 | 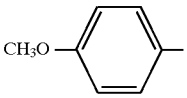 | 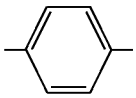 |
| B-35 | 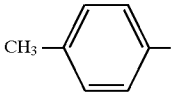 | — | 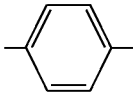 |
| B-36 | 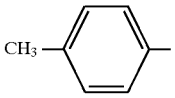 | — | 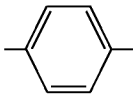 |
| B-37 | 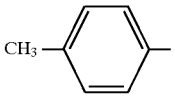 | — | 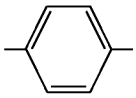 |
| B-38 | 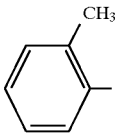 | — | 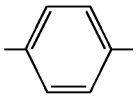 |
| B-39 | 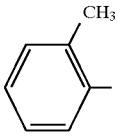 | — | 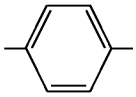 |
| B-40 | 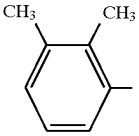 | — | 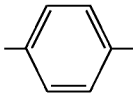 |
| B-41 | 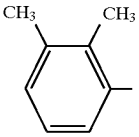 | — | 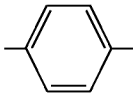 |
| B-42 | 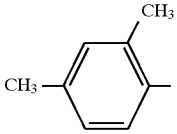 | — | 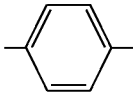 |

-continued
| | | | |
|---|---|---|---|
| B-43 | 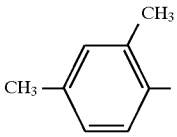 | — | 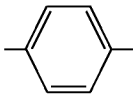 |
| B-44 | 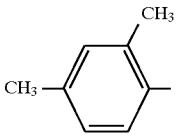 | — | 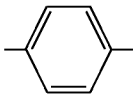 |
| B-45 | 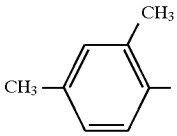 | — | 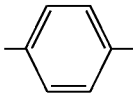 |
| B-46 | 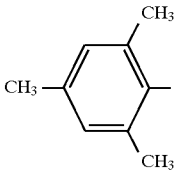 | — | 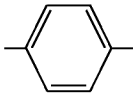 |
| B-47 | 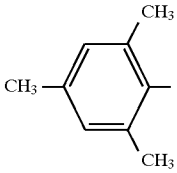 | — | 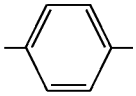 |
| B-48 | 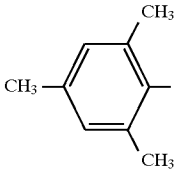 | — | 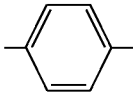 |
| B-49 | 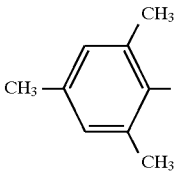 | — | 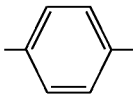 |
| B-50 | 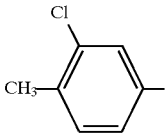 | — | 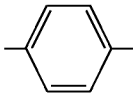 |
| | | $Ar_4$ | $R_1$ | l |
|---|---|---|---|---|
| | B-1 | 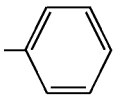 | H | 1 |
| | B-2 | 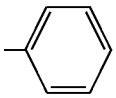 | H | 1 |

-continued
| | | | |
|---|---|---|---|
| B-3 | 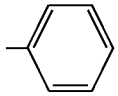 | H | 1 |
| B-4 | 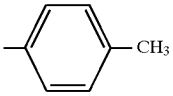 | H | 1 |
| B-5 | 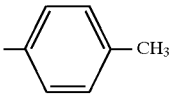 | H | 1 |
| B-6 | 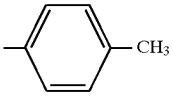 | H | 1 |
| B-7 | 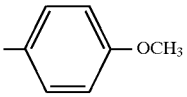 | H | 1 |
| B-8 | 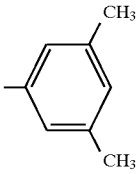 | H | 1 |
| B-9 | 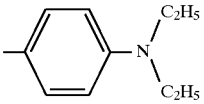 | H | 1 |
| B-10 | 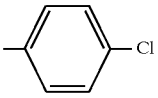 | H | 1 |
| B-11 | 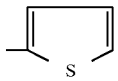 | H | 1 |
| B-12 | 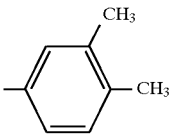 | H | 1 |
| B-13 | 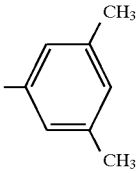 | H | 1 |
| B-14 | 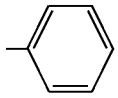 | 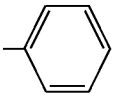 | 1 |
| B-15 | 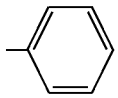 | 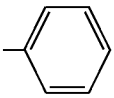 | 1 |

-continued
| | | | |
|---|---|---|---|
| B-16 | 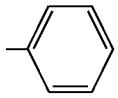 | 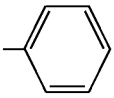 | 1 |
| B-17 | 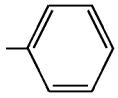 | 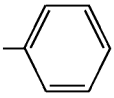 | 1 |
| B-18 | 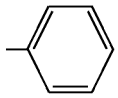 | 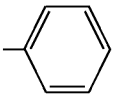 | 1 |
| B-19 | 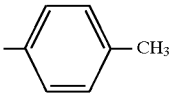 | 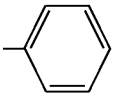 | 1 |
| B-20 | 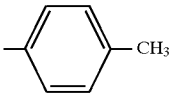 | 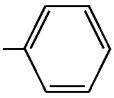 | 1 |
| B-21 | 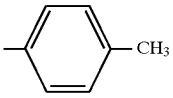 | 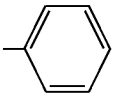 | 1 |
| B-22 | 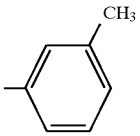 | 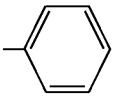 | 1 |
| B-23 | 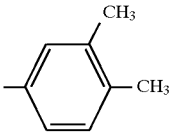 | 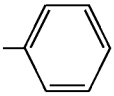 | 1 |
| B-24 | 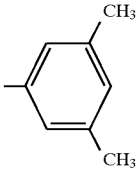 | 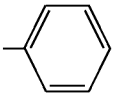 | 1 |
| B-25 | 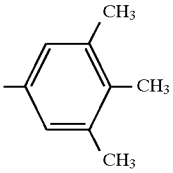 | 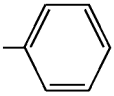 | 1 |
| B-26 | 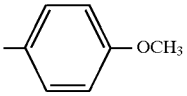 | 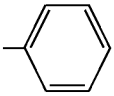 | 1 |
| B-27 | 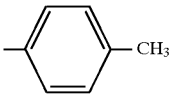 | 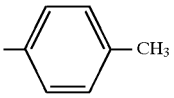 | 1 |

-continued
| | | | |
|---|---|---|---|
| B-28 | 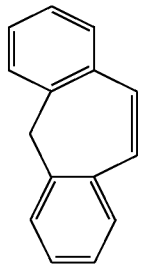 | | 1 |
| B-29 | 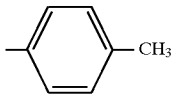 | 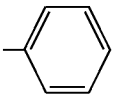 | 1 |
| B-30 | 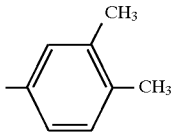 | 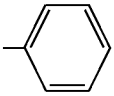 | 1 |
| B-31 | 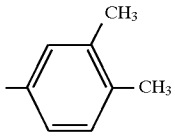 | 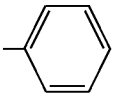 | 1 |
| B-32 | 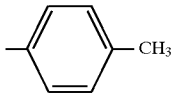 | 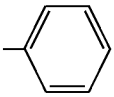 | 1 |
| B-33 | 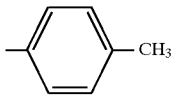 | 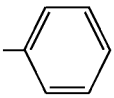 | 1 |
| B-34 | 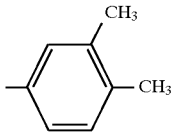 | 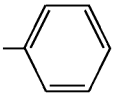 | 1 |
| B-35 | 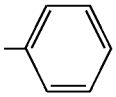 | H | 2 |
| B-36 | 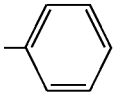 | 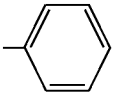 | 2 |
| B-37 | 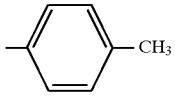 | 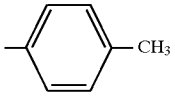 | 2 |
| B-38 | 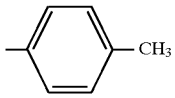 | 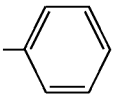 | 2 |
| B-39 | 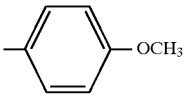 | 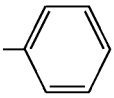 | 2 |

-continued

| | | | |
|---|---|---|---|
| B-40 | 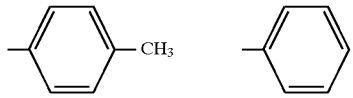 | | 2 |
| B-41 | 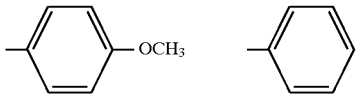 | | 2 |
| B-42 | 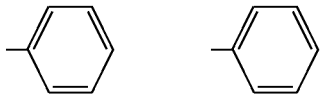 | | 2 |
| B-43 | 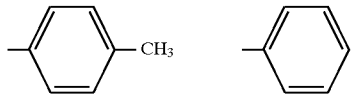 | | 2 |
| B-44 | 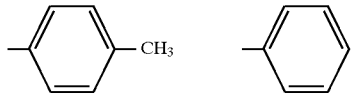 | | 2 |
| B-45 | 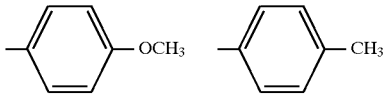 | | 2 |
| B-46 | 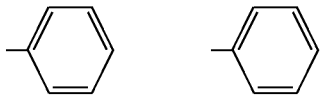 | | 2 |
| B-47 | 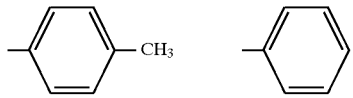 | | 2 |
| B-48 | 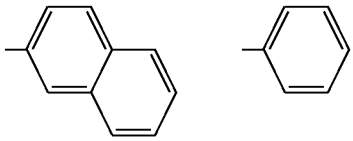 | | 2 |
| B-49 | 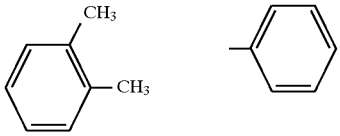 | | 2 |
| B-50 | 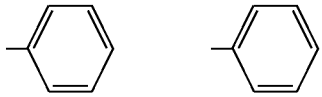 | | 2 |

In the present invention, the carrier transport layer preferably contains a carrier transport material expressed by the following formula II.

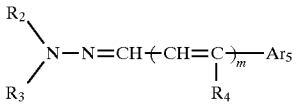

Formula II

In the above formula, $R_2$ and $R_3$ represent a substituted or unsubstituted aromatic hydrocarbon group, heterocyclic group or alkyl group. $R_4$ represents a hydrogen atom or a substituted or unsubstituted aromatic hydrocarbon group, heterocyclic group or alkyl group. $Ar_5$ represents a substituted or unsubstituted aromatic hydrocarbon group or heterocyclic group. In this case, m is 0 or 1. Preferably, $R_2$ and $R_3$ are a methyl group, ethyl group, phenyl group, naphthyl group, and thienylmethyl group. Preferable examples of $R_4$ are a hydrogen atom, and a phenyl group. Preferable examples of $Ar_5$ are benzene, pyrene, thiophene, pyridine, and carbazole. Most preferable examples of $Ar_5$ are benzene, pyrene, and carbazole. Preferable examples of the substituents of $Ar_5$ are: an alkyl group having 1 to 6 carbon atoms, a dialkylamino group, and a diarylamino group.

Examples of compounds represented by the formula II are shown as follows.

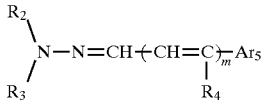
| | $R_2$ | $R_3$ | $R_4$ | $Ar_5$ | m |
|---|---|---|---|---|---|
| C-1 | 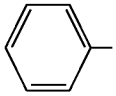 | 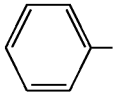 | — | 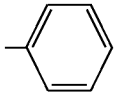 | 0 |
| C-2 | 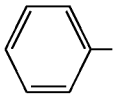 | 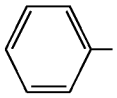 | — | 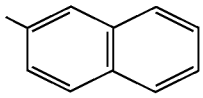 | 0 |
| C-3 | 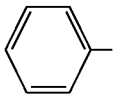 | 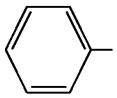 | — | 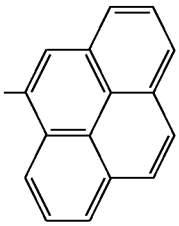 | 0 |
| C-4 | 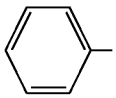 | 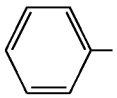 | — | 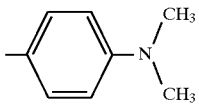 | 0 |
| C-5 | 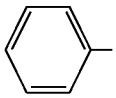 | 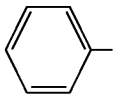 | — | 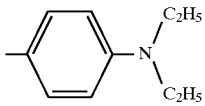 | 0 |
| C-6 | 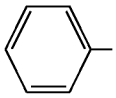 | 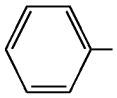 | — | 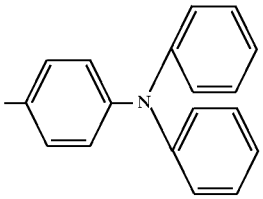 | 0 |
| C-7 | 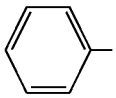 | 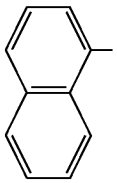 | — | 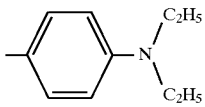 | 0 |
| C-8 | 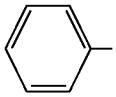 | 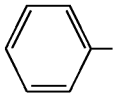 | — | 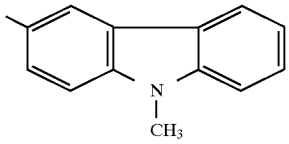 | 0 |
| C-9 | 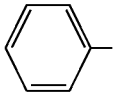 | 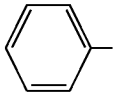 | — | 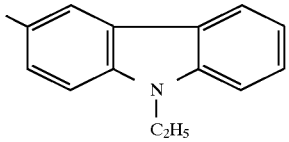 | 0 |

-continued
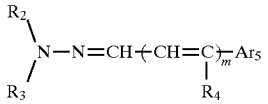
| | $R_2$ | $R_3$ | $R_4$ | $Ar_5$ | m |
|---|---|---|---|---|---|
| C-10 | 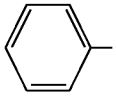 | 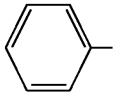 | — | 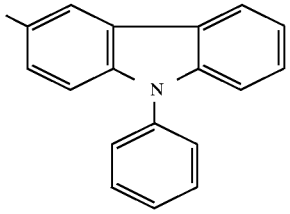 | 0 |
| C-11 | 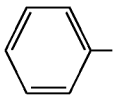 | 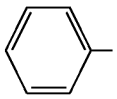 | — | 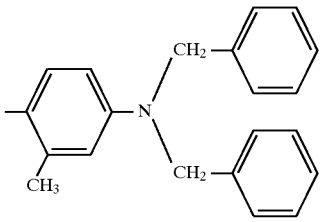 | 0 |
| C-12 | 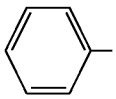 | 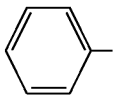 | — | 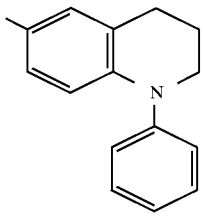 | 0 |
| C-13 | 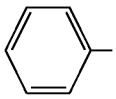 | 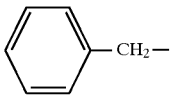 | — | 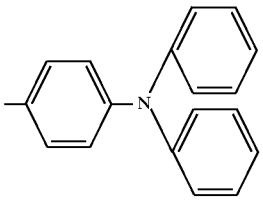 | 0 |
| C-14 | 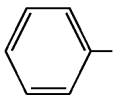 | 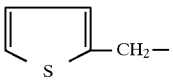 | — | 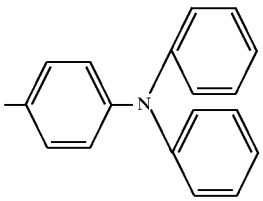 | 0 |
| C-15 | 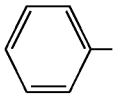 | 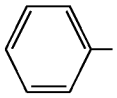 | — | 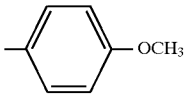 | 0 |
| C-16 | 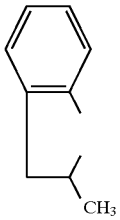 | | — | 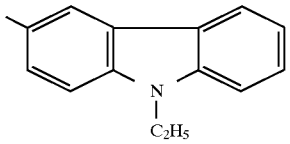 | 0 |

-continued

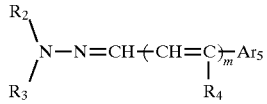

| | $R_2$ | $R_3$ | $R_4$ | $Ar_5$ | m |
|---|---|---|---|---|---|
| C-17 | 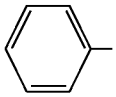 | 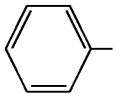 | H | 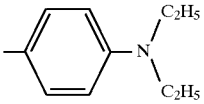 | 1 |
| C-18 | 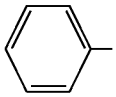 | 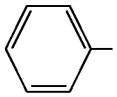 | H | 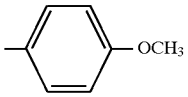 | 1 |
| C-19 | 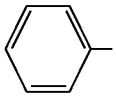 | 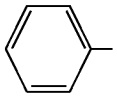 | 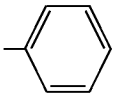 | 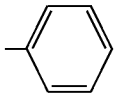 | 1 |
| C-20 | 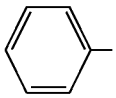 | 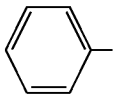 | 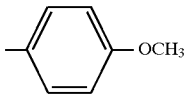 | 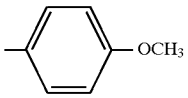 | 1 |

Further, the carrier transport layer preferably contains a carrier transport material expressed by the following formula III is used.

Formula III

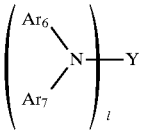

In the above formula, Y represents a mono-, di- or trivalent aromatic residual group. Preferable examples of the aromatic residual groups are substituted or unsubstituted benzene, naphthalene, pyrene, fluorene, carbazole, biphenyl, or 4,4'-alkylidendiphenyl. $Ar_6$ and $Ar_7$ represent a substituted or unsubstituted aromatic hydrocarbon group or heterocyclic group, wherein l is an integer from 1 to 3.

An alkyl group having 1 to 6 carbon atoms is preferable as a substituent of Y. Benzene is preferable as $Ar_6$ and $Ar_7$. An alkyl group having 1 to 6 carbon atoms aryl group, alkoxy group or aryloxy group are preferable as the substituent on $Ar_6$ or $Ar_7$.

Examples of typical chemical compounds represented by the formula III are shown as follows.

Formula III

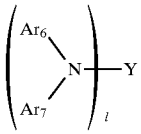

| | $Ar_6$ | $Ar_7$ | Y | l |
|---|---|---|---|---|
| D-1 | 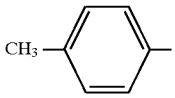 | 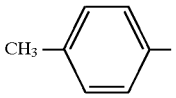 | 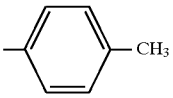 | 1 |
| D-2 | 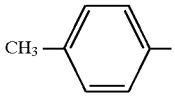 | 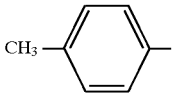 | 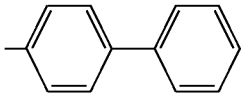 | 1 |
| D-3 | 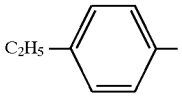 | 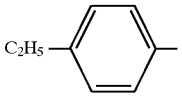 | 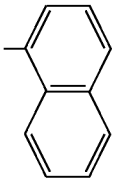 | 1 |

-continued
Formula III
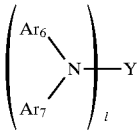
| | $Ar_6$ | $Ar_7$ | Y | l |
|---|---|---|---|---|
| D-4 | 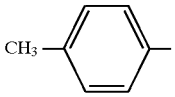 | 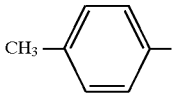 | 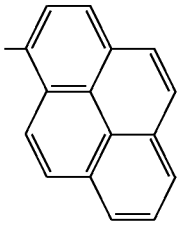 | 1 |
| D-5 | 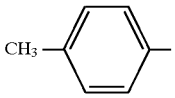 | 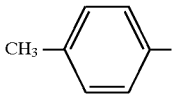 | 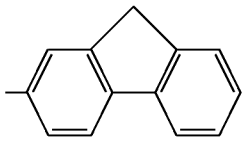 | 1 |
| D-6 | 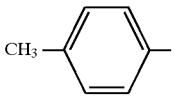 | 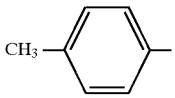 | 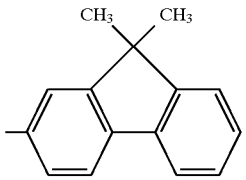 | 1 |
| D-7 | 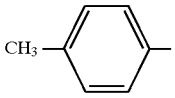 | 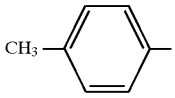 | 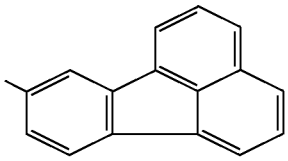 | 1 |
| D-8 | 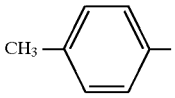 | 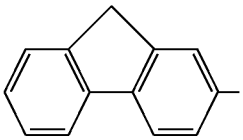 | 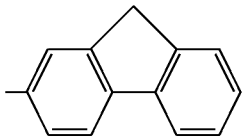 | 1 |
| D-9 | 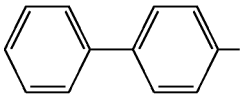 | 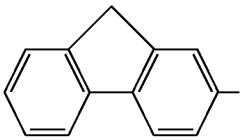 | 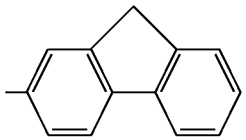 | 1 |
| D-10 | 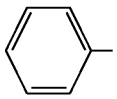 | 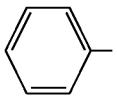 | 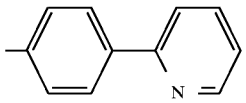 | 1 |
| D-11 | 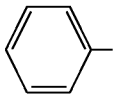 | 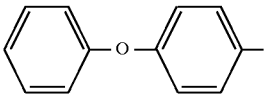 | 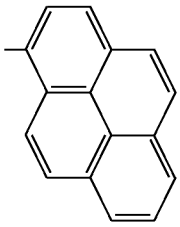 | 1 |

-continued
Formula III
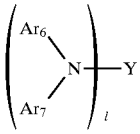
| | $Ar_6$ | $Ar_7$ | Y | l |
|---|---|---|---|---|
| D-12 | 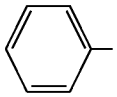 | 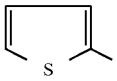 | 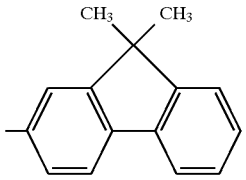 | 1 |
| D-13 | 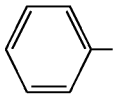 | 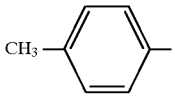 | 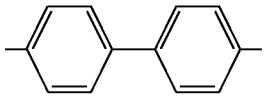 | 2 |
| D-14 | 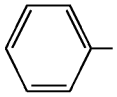 | 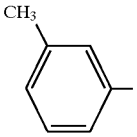 | 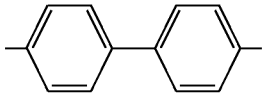 | 2 |
| D-15 | 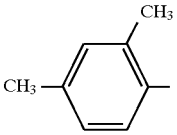 | 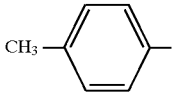 | 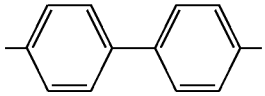 | 2 |
| D-16 | 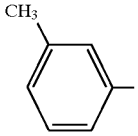 | 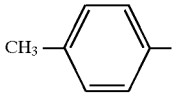 | 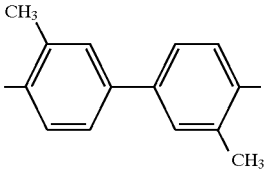 | 2 |
| D-17 | 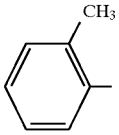 | 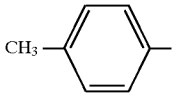 | 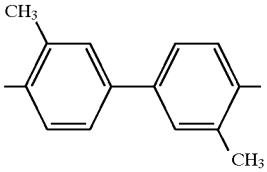 | 2 |
| D-18 | 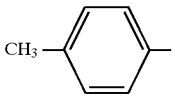 | 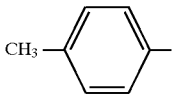 | 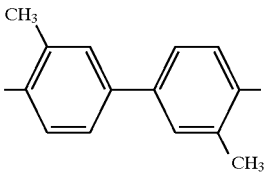 | 2 |
| D-19 | 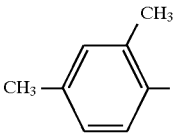 | 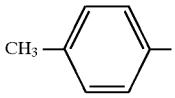 | 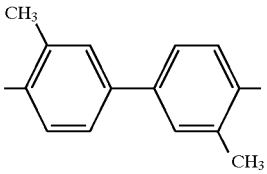 | 2 |

-continued
Formula III
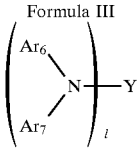
| | $Ar_6$ | $Ar_7$ | Y | l |
|---|---|---|---|---|
| D-20 | 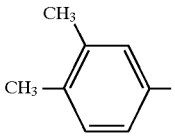 | 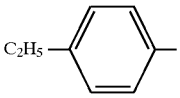 | 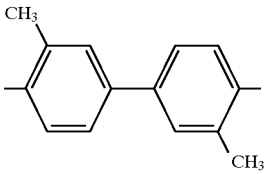 | 2 |
| D-21 | 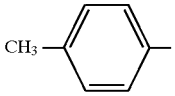 | 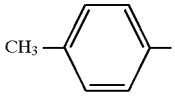 | 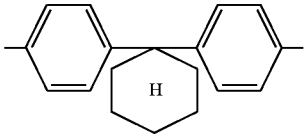 | 2 |
| D-22 | 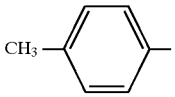 | 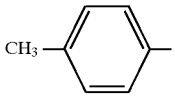 | 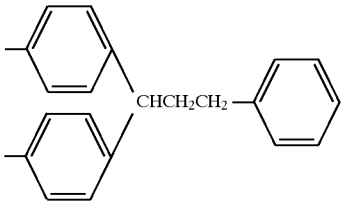 | 2 |
| D-23 | 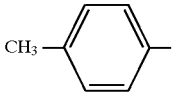 | 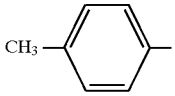 | 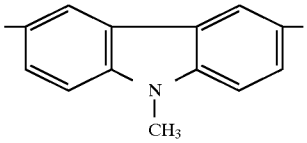 | 2 |
| D-24 | 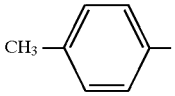 | 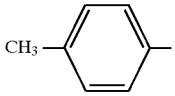 | 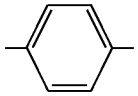 | 2 |
| D-25 | 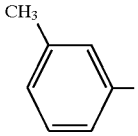 | 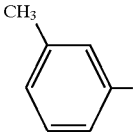 | 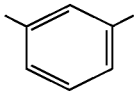 | 2 |
| D-26 | 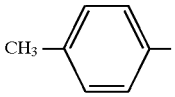 | 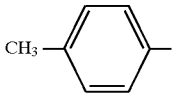 | 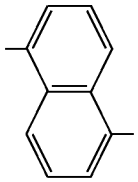 | 2 |
| D-27 | 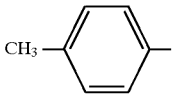 | 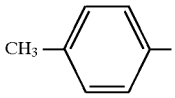 | 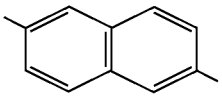 | 2 |
| D-28 | 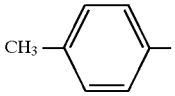 | 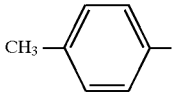 | 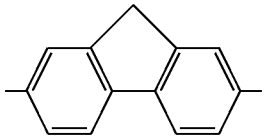 | 2 |

-continued

Formula III

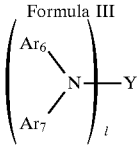

| | $Ar_6$ | $Ar_7$ | Y | l |
|---|---|---|---|---|
| D-29 | 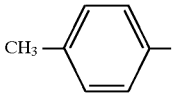 | 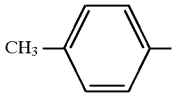 | 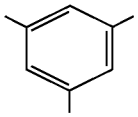 | 3 |
| D-30 | 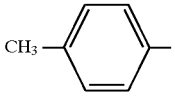 | 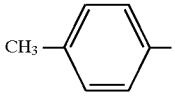 | 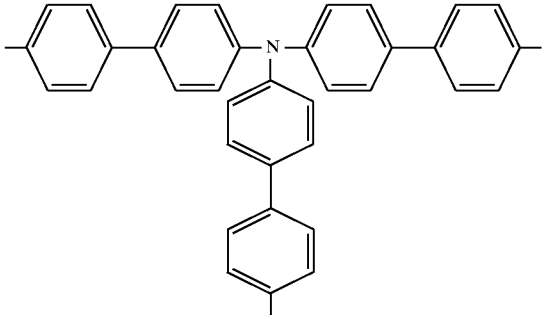 | 3 |

Furthermore, the carrier transport layer preferably contains a carrier transport material expressed by the following formula IV is used.

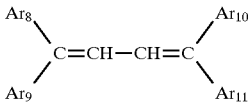

Formula IV

In the formula, $Ar_8$, $Ar_9$, $Ar_{10}$ and $Ar_{11}$ represent a substituted or unsubstituted aromatic hydrocarbon group or heterocyclic group. Preferable example is benzene. As a substituent is preferable a dialkylamine group or diarylamine group.

Examples of typical compounds represented by the formula IV are shown as follows.

Formula IV

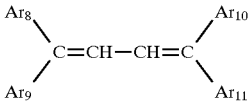

| | $Ar_8$ | $Ar_9$ | $Ar_{10}$ | $Ar_{11}$ |
|---|---|---|---|---|
| E-1 | 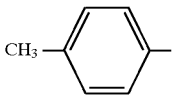 | 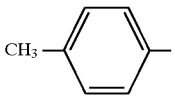 | 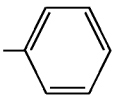 | 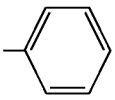 |
| E-2 | 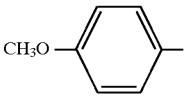 | 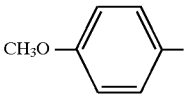 | 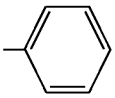 | 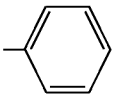 |
| E-3 | 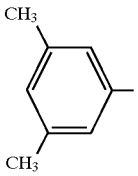 | 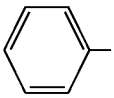 | 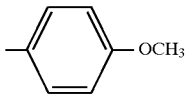 | 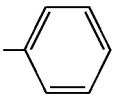 |

-continued

Formula IV

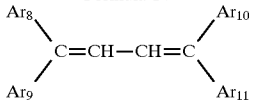

| | $Ar_8$ | $Ar_9$ | $Ar_{10}$ | $Ar_{11}$ |
|---|---|---|---|---|
| E-4 | 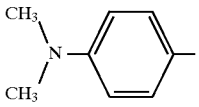 | 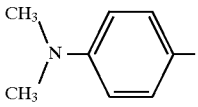 | 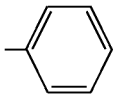 | 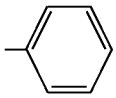 |
| E-5 | 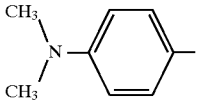 | 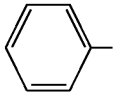 | 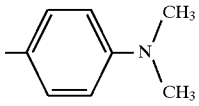 | 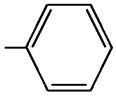 |
| E-6 | 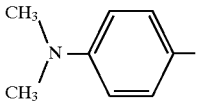 | 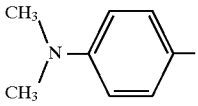 | 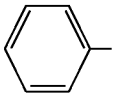 | 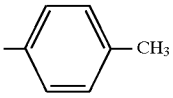 |
| E-7 | 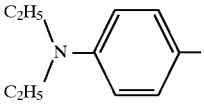 | 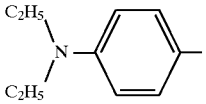 | 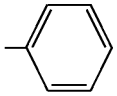 | 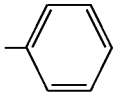 |
| E-8 | 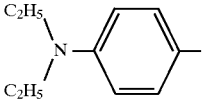 | 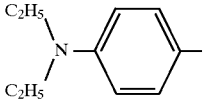 | 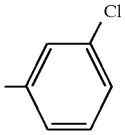 | 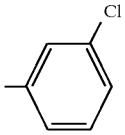 |
| E-9 | 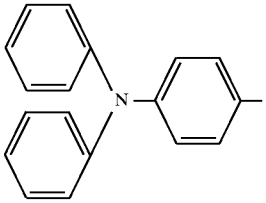 | 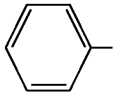 | 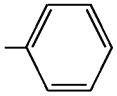 | 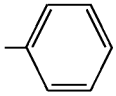 |
| E-10 | 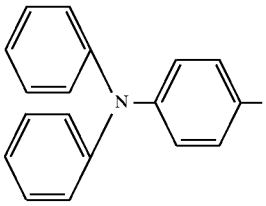 | 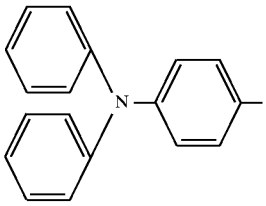 | 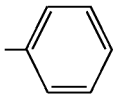 | 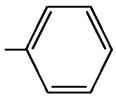 |

Formula V

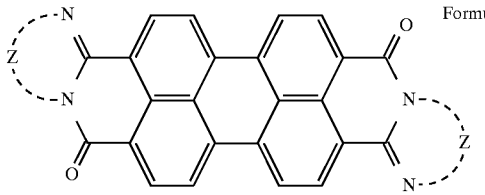

Formula VI

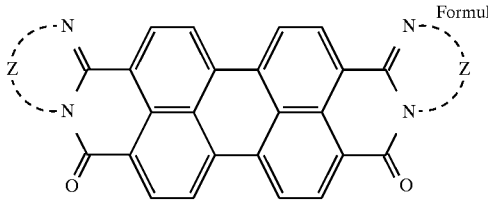

In the present invention, it is preferable that the photoreceptive layer contains a charge carrier generation material represented by the following formula [V] or [VI], and when the charge carrier generated from the charge carrier generation material by an image-exposure to the photoreptive layer is transferred to form an electrostatic latent image on the surface of the photoreptive layer, a drift mobility of the carrier is not less than $1\times10^{-6}$ $cm^2$/V.sec under the condition of the electric field intensity of $2\times10^5$ V/cm.

In the formula, Z represents a group of atoms necessary for forming a substituted or unsubstituted aromatic ring. Preferable examples of the aromatic rings are a benzene ring, naphthalene ring, anthracene ring, phenanthrene ring, pyridine ring, pyrimidine ring, pyrazole ring, and anthraquinone ring. Among these is preferable benzene ring or naphthalene ring. The aromatic rings may be substituted. Examples of the substituents are an alkyl group, alkoxy group, aryl group, aryloxy group, acyl group, acyloxy group, amino group, carbamoyl group, halogen atom, nitro group, and cyano group.

In the present invention, it is preferable that the perylene compound expressed by the formula V or VI has the peaks at Bragg Angle 2θ of 6.3°±0.2°, 12.5°±0.2°, 25.4°±0.2°, and 27.0°±0.2°.

In the present invention, it is preferable that the photoreceptive layer contains a charge carrier generation material represented by the following formula [VII], and when the charge carrier generated from the charge carrier generation material by an image-exposure to the photoreptive layer is transferred to form an electrostatic latent image on the surface of the photoreptive layer, a drift mobility of the carrier is not less than $1\times10^{-6}$ $cm^2$/V.sec under the condition of the electric field intensity of $2\times10^5$ V/cm.

Formula VII

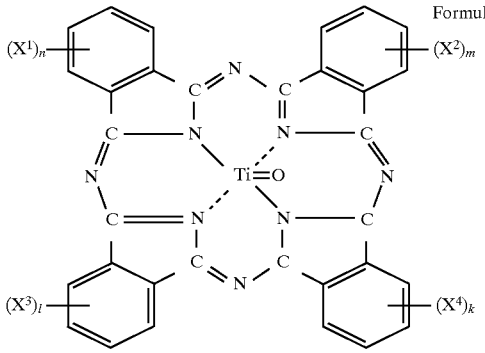

In the above formula, $X^1$, $X^2$, $X^3$ and $X^4$ represent Cl, Br or F, and n, m, l and k represent an integer of 0 to 4. In the compound represented by the above formula VII, it is preferable that l, m, n and k are 0. It is more preferable that the compound expressed by the above formula VII is a titaniumphthalocyanine pigment in which the primary peaks are located at Bragg Angle 2θ of at least 9.5±0.2°, 24.1±0.2°, and 27.3±0.2° with respect to CuKα characteristic X rays (wavelength 1.541 Å), or alternatively a titaniumphthalocyanine pigment in which the primary peaks at Bragg Angle 2θ of 9.0±0.2°, 24.1±0.2°, and 27.3±0.2° with respect to CuKα characteristic X rays (wavelength 1.541 Å).

Concerning the measurement method of carrier mobility used in the present invention, the time-of-flight (TOF) method is well known. The measurement method is described in, for example, J. Appl. Phys. 43 5033(1972), J. Appl. Phys. 60 4287(1986), or Phys. Review B 26 3105 (1982). The specific measurement procedure applied to the present invention will be described later.

Figure 2:
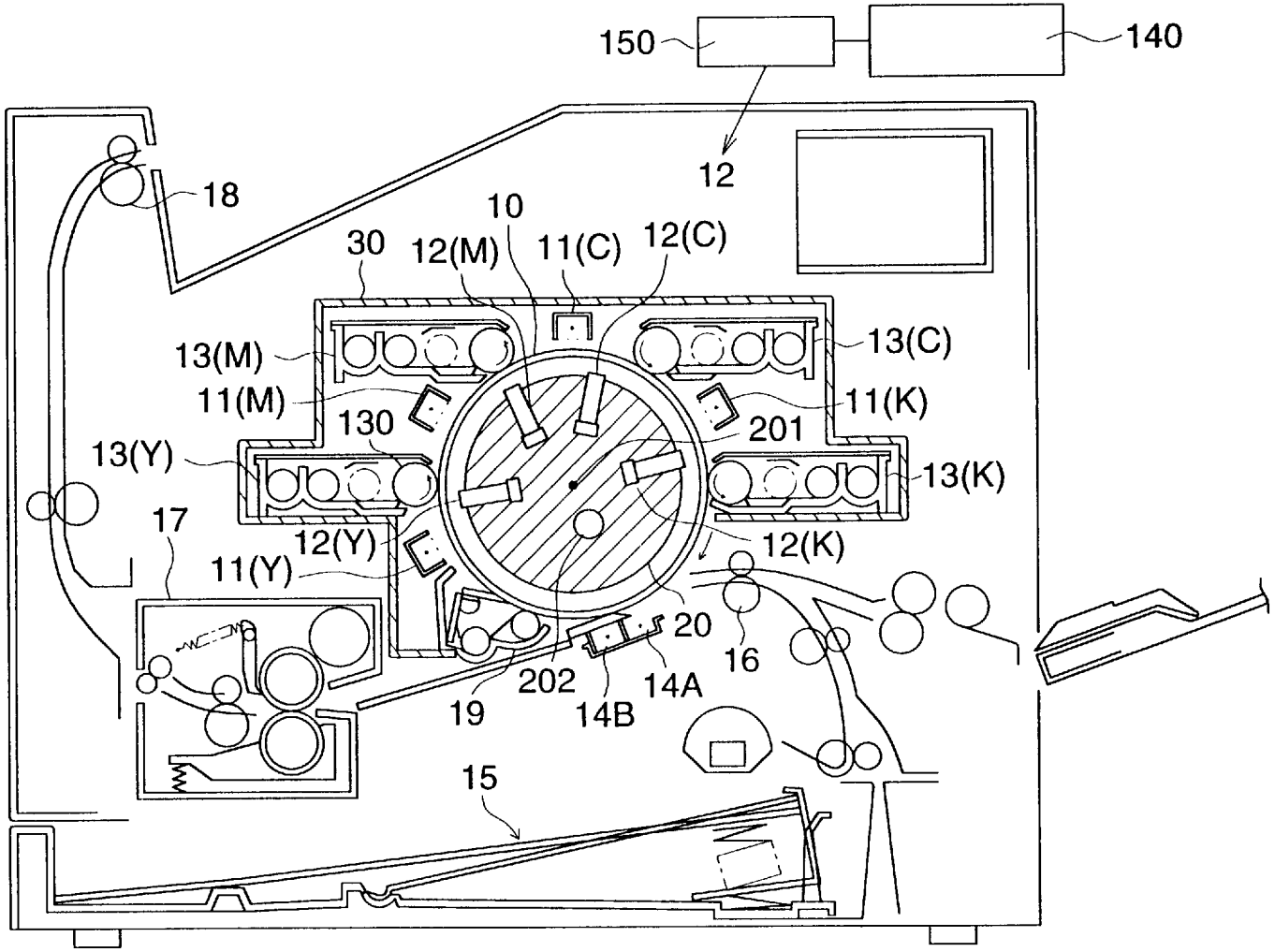
FIG. 2 is a cross-sectional view of the printer in which a cylindrical photoreceptor is used.

FIG. 2 shows an example of the printer used for the explanation of an image forming apparatus to form the aforementioned color images. FIG. 1 is a sectional view of the photoreceptor 10 assembled into the printer. In the drawing, numeral 2 is a cylindrical transparent substrate (support). On the cylindrical transparent substrate, there are provided a transparent conductive layer 3 and an organic photoreceptive layer 6 to obtain the photoreceptor 10.

The photoreceptive layer 6 is provided on the transparent conductive layer 3 via an intermediate layer, if necessary. The photoreceptive layer contains a charge carrier generation material (CGM) and an n-type charge carrier transport material (n-CTM). It is preferable that the photoreceptor 10 includes a photoreceptive layer composed of separate function-separated dual layers, wherein the charge generation layer 4 (CGL) containing CGM forms a lower layer, and the charge transport layer 5 (CTL) containing the aforementioned n-CTM forms an upper layer.

In the dual layer type photoreceptor 10, CGL4 is comprised of a pigment dispersed in the binder resin. In this case, examples of usable pigments are an azo pigment such as Sudan red or Dian blue; a quinone pigment such as pyrenequinone or anthanthrene; an indigo pigment such as indigo or thioindigo; an azulenium salt pigment; and a phthalocyanine pigment such as copper phthalocyanine, phthalocyanine, or titanium phthalocyanine. Examples of usable binders are polyester, polycarbonate, polystyrene, polyvinyl butyral, polyvinyl acetate, acryl resin, polyvinyl pyrrolidone, ethyl cellulose, or cellulose acetate butyrate.

In order to form CGL4 composed of the above CGM dispersion layer, the above CGM and the binder are dissolved and dispersed in one or more of the following solvents. As examples of the solvents are hydrocarbon such as toluene or xylene; halogenated hydrocarbon such as methylene chloride, 1,2-dichloroethane; ketone such as methylethylketone, or cyclohexanone; ester such as ethyl acetate, or butyl acetate; alcohol such as methanol, ethanol, propanol, butanol, methyl cellosolve, and ethyl cellosolve, and derivatives thereof; ether such as tetrahydrofuran, or 1,4-dioxane; amine such as pyridine or diethylamine; nitrogen compound including amide such as N,N-dimethyl formamide; phenol such as fatty acid; and sulphur or phosphor compound such as carbon disulfide or triethyl phosphate. In this case, the above CGM and the binder are dissolved and dispersed in the above solvents using a ball mill, homomixer or sand mill, or alternatively by means of ultrasonic dispersion. In this way, the coating solution is made. The thus obtained coating solution is coated on the transparent conductive layer 3 provided with an intermediate layer if necessary, by a dipping, spraying, blade or roll coating method. After coating, the coated layer is dried.

In CGL 4 described above, the ratio of binder resin: CGM is 0 to 10:1 to 50. Thickness of the CGL is 0.01 to 10 μm, and preferably, 0.1 to 5 μm.

CTL5 is formed on CGL4 by dissolving (or dispersing) n-CTM relating to the present invention singly in the solvent or alternatively in the solvent together with binder resin and coating the solution with an applicator or bar-coater. After the completion of coating, the coated layer is dried.

As examples of the usable binder resins to form CTL5 are cited polystyrene, acryl resin, methacryl resin, vinylchloride resin, vinylacetate resin, polyvinyl butyral resin, epoxy resin, polyurethane resin, phenol resin, polyester resin, alkyd resin, polycarbonate resin, silicon resin, and melamine resin. Further, examples of the binder resins are copolymer resin containing two or more of the above resins; insulating resin of the above resins; and organic semiconductive polymer such as polyvinyl carbazole. The solvent in which the aforementioned n-CTM and the binder resin are dissolved or dispersed is selected from the solvents used for forming the aforementioned CGL.

Concerning the aforementioned n-CTM, 20 to 200 weight parts of n-CTM are added to 100 weight parts of binder resin. It is preferable that 30 to 150 weight parts of n-CTM are added to 100 weight parts of binder resin. In this case, the thickness of CTL5 is 5 to 50 μm.

It is preferable that the photoreceptive layer provided on the transparent support has a sufficiently high light absorbing property with respect to the exposure light. Unless the exposure light is sufficiently absorbed by the photoconductive layer, the exposure light sent from the support side transmits the photoconductive layer and then is reflected and irradiated by the members arranged in the periphery of the photoreceptor, and the thus reflected and irradiated light is incident on the photoreceptive layer again, so that blurred image and moire are frequently caused on a formed image.

As described above, in order to prevent the deterioration of image quality, it is necessary to lower the light transmittance of the photoreceptive layer so that the light transmission of the photoreceptor including the transparent support can be reduced. In order to lower the light transmittance, it is most effective to control the light transmittance of the light-absorptive carrier generation layer (CGL) of the photoreceptive layer. When the transmittance of CGL exceeds 20%, an amount of light transmitted through the photoreceptive layer is remarkably increased, so that blur and moire are caused on an image, and the sharpness of the image is remarkably deteriorated. It is more preferable that the light transmittance is not more than 10%. On the other hand, in order to increase the absorption of light of CGL, it is necessary to increase the content of CGM (carrier generation material) in CGL, and also it is necessary to increase the thickness of CGL so that the CGM content can be increased. Concerning the generation of carrier caused by the exposure from the support side in this case, the carrier is generated in the vicinity of the interface between the support and CGL. Therefore, the generated carrier must pass through CGL and CTL so that the carrier can reach a surface of the photoreceptor. Accordingly, it is required that the dynamic sensitivity characteristic is high. In the image forming apparatus in which a photoreceptive layer of 60 to 160 mm in thickness is provided on a transparent support and by a process of charging, exposing and developing corresponding to black, yellow, magenta and cyan are provided, a color image can be formed by one revolution of the photoreceptor, it is required that a period of time from image exposure to development is short. When the dynamic sensitivity of the photoreceptor is lowered, the occurrence of fog is increased and a previous color image becomes a memory and appears on the successive image. In this way, the image quality is remarkably deteriorated. In order to solve the above problems, CTM having a carrier mobility of not less than a predetermined value is used in the charge transport layer, so that the carrier generation efficiency of CGL and the mobility can be remarkably improved, and the defect in sensitivity of the photoreceptor caused by the back-side exposure can be remarkably improved. That is, it is necessary that the carrier mobility of the carrier transport layer is $1\times10^6$ $cm^2$/V.sec or more under the condition of the electric field intensity of $2\times10^5$ V/cm.

Concerning the cylindrical transparent substrate 2 of the photoreceptor 10, it is preferable that the strength and the resistance against mechanical impact or abrasion are high and further the dimensional accuracy is high and furthermore the section is close to a true circle. It is also preferable that the light transmittance is high with respect to LED light. It is preferable that the transmittance is not less than 80%. For example, glass or plastic material such as polycarbonate, PET or polystyrene is preferably used.

Figure 3:
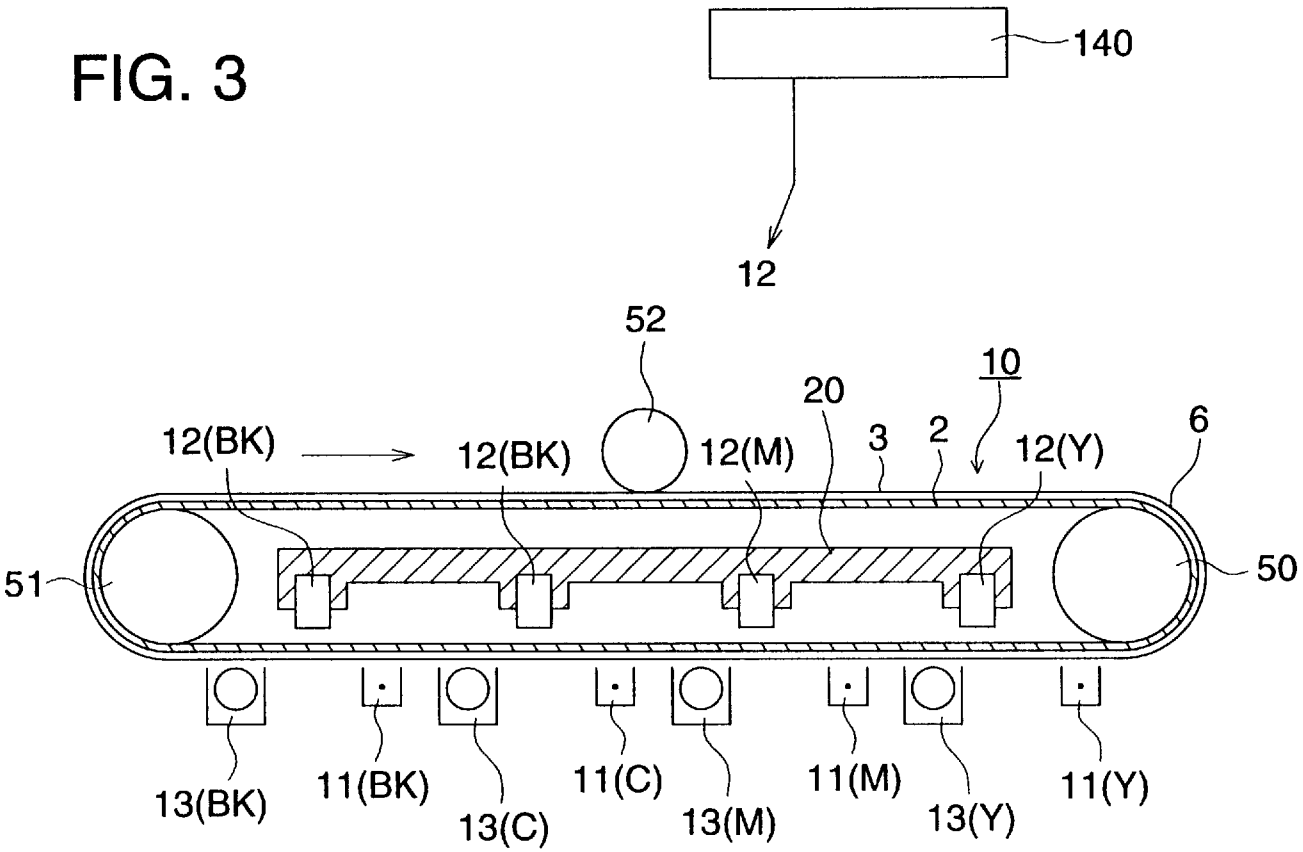
FIG. 3 is a cross-sectional view of the printer in which a belt-shaped photoreceptor is used.
Figure 4:
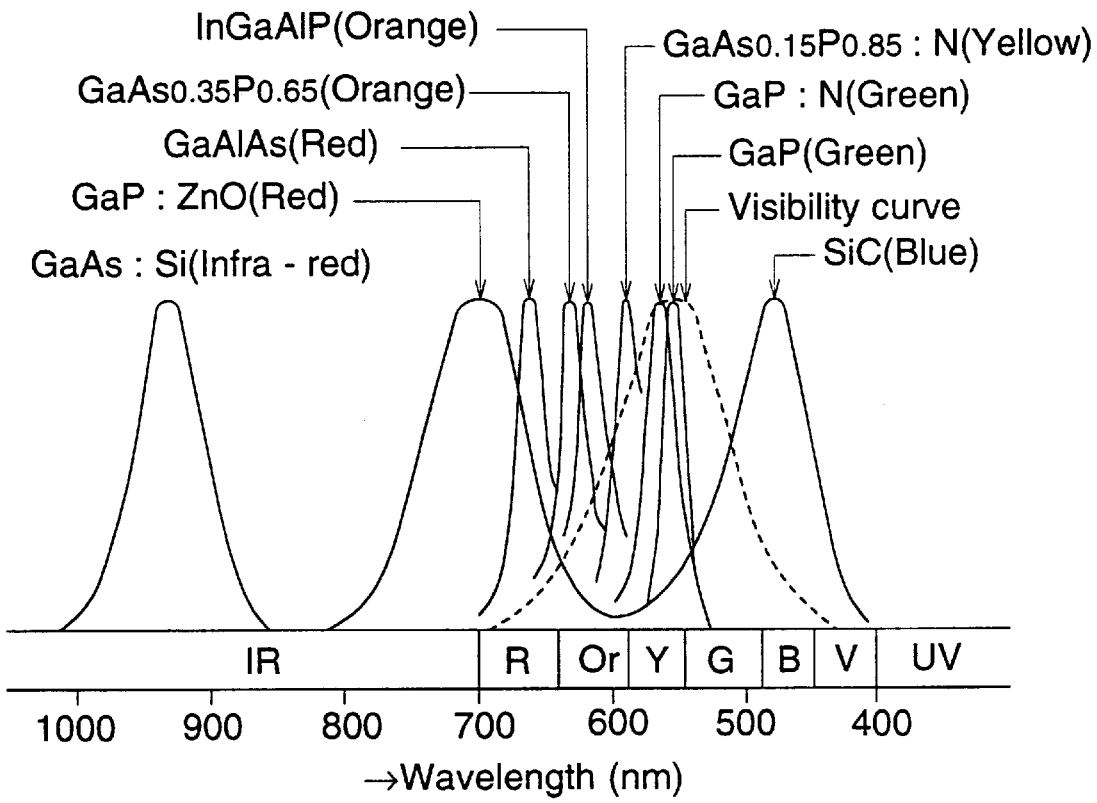
FIG. 4 is a view showing a light emitting wavelength range of LED.

When the transparent body 2 is applied to the belt-shaped photoreceptor used for the printer shown in FIG. 3, it is necessary that the abrasion resistance and the dimensional accuracy are high, and further it is necessary that the photoreceptor belt is trained and rotated round the drive roller 50 and idle roller 51 without slipping. It is preferable that the transmittance is high with respect to LED light. It is preferable that the transmittance is not less than 80%. For example, a belt-shaped plastic such as polyimide, polyamide or cellulose acetate is used, or alternatively rubber such as urethane rubber is used.

In the printer illustrated in FIG. 3, a belt-shaped photoreceptor is used instead of the cylindrical photoreceptor illustrated in FIG. 2. Other points are the same as those of the printer illustrated in FIG. 2. Like parts are identified by the same reference character in each of the drawings.

Concerning the transparent conductive layer 3 provided on the transparent substrate 2, metal or alloy is used. Examples of usable metals are: Al, Au, Ag, Cu, Ni, Ti, Zn, Cr, In, Sn, In, Sn, Pb, or Fe. Also, one of alloys of these metals is used. Alternatively, the metallic oxide such as ITO, $SnO_2$, $In_2O_3$ or alumite is used. These are formed into a thin layer, the thickness of which is 100 Å to 5 μm, by means of vapor-deposition, spattering, glow discharge, plasma CVD or plating. In this way, the transparent conductive layer is provided.

Alternatively, conductive polymer or fine powder made of the aforementioned metal, alloy, metal oxide or diamond-type crystal carbon is dispersed into resin binder such as polyamide, polyvinyl alcohol, polyvinyl butyral, ethyl cellulose, sulfoxymethyl cellulose, vinylchloride and vinylacetate copolymer, vinylchloride and vinylacetate maleic acid copolymer. The thus obtained coating solution is coated so that a thin layer of 0.1 to 10 μm thickness is formed.

It is preferable that the surface resistance of the transparent conductive layer 3 is not more than $10^8$ Ω. It is more preferable that the surface resistance of the transparent conductive layer 3 is not more than $10^6$ Ω. When the surface resistance exceeds $10^8$ Ω, a sufficiently high electric current does not flow at the time when charging the photoreceptor, which causes defective charging. Further a sufficiently high photocurrent does not flow in the case of irradiation of light, which causes defective sensitivity.

When necessary, the interlayer of 0.1 μm to 1 mm thickness is provided on the transparent conductive layer 3. As examples of usable materials thereof are cited polyamide, polyvinyl alcohol, ethyl cellulose, vinyl chloride and vinyl acetate copolymer resin, and vinyl chloride and vinyl acetate maleic acid copolymer resin.

As illustrated in FIG. 1, inside the substrate of the photoreceptor 10, there are provided four LED arrays 7(Y), 7(M), 7(C) and 7(BK) which respectively emit light in accordance with signals of four colors of yellow (Y), magenta (M), cyan (C) and black (BK). Further, there are provided exposure units 12(Y), 12(M), 12(C) and 12(BK) respectively having selfoc lenses 8(Y), 8(M), 8(C) and 8(BK), wherein the exposure units are respectively connected with the LED arrays. The above units are arranged while they are fixed to the support member 20 extending from the apparatus main body.

With reference to FIG. 2, the image forming method and apparatus of the present invention will be explained below, in which the afore-mentioned photoreceptor 10 is used.

Binary digital image signals of each color Y, M, C, BK are sent from the external signal source 140 such as an image scanner or a computer. The binary digital image signals are successively inputted into the exposure unit 12 composed of the red LED of 400 dpi so that a red image can be formed.

In accordance with the start of image recording, the photoreceptor drive motor is started. A gear (not shown)

mounted on the rotational shaft of the photoreceptor 10 is meshed with a drive gear connected with the motor. By the drive of the gears, the photoreceptor 10 is rotated in the arrowed direction, and at the same time a surface of the photoconductive layer 6 on the photoreceptor 10 is given a uniform positive charge by the charger 11 (Y).

Next, Y image signals are outputted to the exposure unit 12(Y) by the external signal source 140. In accordance with the Y image signals, the LED array 7(Y) emits light, so that a surface of the photoconductive layer 6 is exposed via the selfoc lens 8(Y). In this way, a dot-shaped positive electrostatic latent image is formed. In the case of reversal development, a Y toner image is formed by the developing unit 13(Y) filled with developer containing positively charged Y toner under the condition of non-contact.

On the photoreceptor 10, a uniform positive electric charge is given on the Y toner image by the charger 11(M). The photoreceptor 10 is exposed to light by the exposure unit 12(M) upon which an M image signal voltage is impressed, so that a dot-shaped M electrostatic latent image is formed. In the same manner as described before, the electrostatic latent image is developed by the developing unit 13(M) under the condition of non-contact. In this way, an M toner image is formed on the Y toner image previously formed.

In the same process as described before, a C toner image is formed by the charger 11(C), exposure unit 12(C) and developing unit 13(C). A BK toner image is formed by the charger 11(BK), exposure unit 12(BK) and developing unit 13(BK). The thus formed toner images are superimposed. In this way, a color toner image is formed on the surface of the photoconductive layer 6 in one cycle.

In the development conducted by each developing unit 13, a DC bias voltage close to the charging potential of the photoreceptor 10 is impressed upon the development sleeve 130, and further an AC bias voltage of 0.5 to 10 kHz, 0.2 to 2 $kv_{(p-p)}$ is impressed upon the development sleeve 130 so that the AC bias voltage is superimposed on the DC bias voltage. Then the toner image is subjected to non-contact reversal development in which one component developer or two component developer is used.

In this way, a color toner image is formed on the circumferential surface of the photoreceptor 10. The thus formed color toner image is transferred onto a transfer sheet conveyed from the sheet feed cassette and synchronously fed by the action of the timing roller 16.

Electric charge on the transfer sheet onto which the toner image has been transferred is removed by the discharger 14*b*, so that the transfer sheet is separated from the circumferential surface of the photoreceptor drum. Toner on the transfer sheet is fused and fixed by the fixing unit 17. After that, the transfer sheet is discharged by the sheet discharge roller 18 onto a tray arranged above the apparatus.

After the completion of transfer, residual toner is removed from the surface of the photoreceptor 10 by the cleaning unit 19, so that the apparatus is prepared for the next image formation.

In this connection, reference numeral 30 is a cartridge for image formation detachably attached to the apparatus body in such a manner that the cartridge covers a support member 20 which supports the exposure units 20. The photoreceptor 10, charger 11, developing unit 13 and cleaning unit 19 are integrally assembled into the cartridge.

In the case of a photoreceptor applied to the color process of one pass formation, when a drum-shaped photoreceptor, the diameter of which is 60 to 160 mm, is used for designing the overall apparatus to be compact, the distances of members are reduced, because around the photoreceptor there are provided a charging member, exposing member, developing member, transferring member and cleaning member for the purpose of developing and transferring the basic colors of black, yellow, magenta and cyan. Consequently, concerning one set of processes of charging, exposing and developing, a distance from the exposing position to the developing position is not more than 10 mm and preferably not more than 5 mm. In the case where images are formed on not less than 10 recording sheets of the size A4 (297 mm), the passing time therebetween is designed to be not more than 150 msec. More preferably, the passing time from the exposing position to the developing position is designed to be not more than 100 msec. Due to the foregoing design, it is possible to sufficiently reduce the distance from the exposing position to the developing position, so that the overall apparatus of one-pass color process can be made compact. In this connection, it is necessary that the passing time from the exposing position to the developing position is set to be not less than 10 msec. When the passing time is shorter than 10 msec, the occurrence of fog is undesirable increased.

In the image forming apparatus of the present invention, a positively charging photoreceptor is used for the photoreceptor 10. A plurality of chargers 11 arranged close to the outer circumference are positively charged. Accordingly, generation of ozone is very small. Therefore, in the process of repetition of image formation, it is possible to avoid the fatigue and deterioration of the photoconductive layer, so that images of high quality can be stably provided. Since the positively charging photoreceptor is used, an amount of ozone discharged outside the image formation area is small. Therefore, it is possible to avoid the environmental pollution.

According to the image forming apparatus of the present invention, CGL 4 on the photoreceptive layer 6 is exposed to light from the inside by each exposure unit. Accordingly, exposure for forming the succeeding color toner image is conducted without being affected by the previous-formed color toner image. In other words, image exposure according to the succeeding image signals of M, C and BK is conducted on the same exposure condition as that of the Y image signal.

Consequently, it is possible to form an electrostatic latent image without any distortion.

In this connection, in the image forming apparatus of the present invention, LED is mainly used for the exposure unit. The reason is that LED is small, light and simple compared with the laser unit, so that it is possible to compactly assemble LED inside the photoreceptor base 2. As is well known, there are provided various LEDs capable of emitting beams of light of various lightwaves. However, red LED and green LED are primarily used.

EXAMPLES

With reference to an embodiment, the present invention will be specifically explained below, however, it should be noted that the present invention is not limited to the specific embodiment.

Preparation of the Photoreceptor (1)

Into the sand mill filled with glass beads, 7 g of the charge generation material (A-1), 1.5 g of polyvinyl butyral resin "Elex BLS" manufactured by Sekisui Kagaku Kogyo Co., and 250 ml of methylethyl ketone were put and dispersed for 15 hours. The thus obtained solution was coated by means of dip-coating on a cylindrical glass support, the diameter of which was 80 mm, the outer surface of which was covered with an ITO transparent conductive layer 3 of 0.1 μm thickness. In this way, the charge generation layer 4, the thickness of which was 0.3 μn, was formed. Next, concerning the charge transport material, 1 weight part of the exemplary chemical compound (B-23), 1.4 weight parts of polycarbonate "Z-200" manufactured by Mitsubishi Gas Kagaku Co., and 10 weight parts of 1,2-dichloroethane were dissolved so as to prepare a solution. The thus prepared solution was dip-coated on the above charge generation layer 4, so that the charge transport layer 5 of 25 μm thickness was formed. In this way, the photoreceptor (1) was provided so as to be used in Example 1.

In this connection, the drift mobility of the carrier (positive hole) generated when the photoreceptor (1) is irradiated with light was measured by the following measurement method. As a result of the measurement, the drift mobility was $1.8\times10^{-5}$ $cm^2$/V.sec.

Measurement of Drift Mobility

The charge generation layer and the charge transport layer were formed in the following manner. Aluminum was vapor-deposited on a glass plate so as to be used for a lower electrode. The coating solution for forming the charge carrier generation layer containing a charge carrier generation material (A-1) used in the photoreceptor (1) was coated on the above glass plate on which aluminum was vapor-deposited, by means of spin coating so that the charge generation layer of 0.1 μm thickness was formed. Further the solution for forming the charge carrier transport layer used in the photoreceptor (1) was coated with an applicator. After that, it was dried at 90° C. In this way, the charge transport layer of 10 to 20 μm thickness was formed.

In this case, the film thickness of the charge transport layer was accurately measured with the Decktack type layer thickness meter.

After that, gold was vapor-deposited on the charge transport layer so that the upper electrode was made. In this way, a sample for measuring the drift mobility of carrier was obtained.

The above sample was put in an electric field, the intensity of which was $2\times10^5$ V/cm. Under the above condition, pulse exposure of 644 nm was conducted through the upper electrode. Waveform of the generated transient photocurrent was recorded by the digital oscilloscope so that the drift mobility of carrier was determined.

Structure of the charge generation material (A-1):

Mixture of (1) and (2)

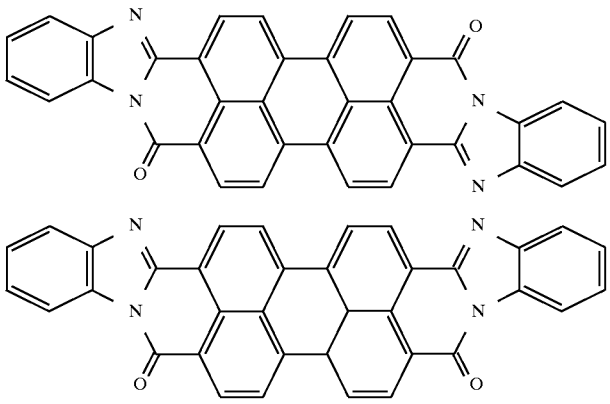

Preparation of Photoreceptor (2) to (9)

Photoreceptors (2) to (4) were prepared in the same manner as photoreceptor (1), except that, instead of the exemplary chemical compound (B-23) of the photoreceptor (1), the exemplary chemical compounds (B-43), (D-6) and (D-14) were used as the charge transport material. The photoreceptors (2) to (4) were used in Examples 2 to 4.

Photoreceptors (5) to (9) were prepared in the same manner as photoreceptor (1), except that, instead of the charge generation material (A-1), the following charge generation material (A-2) was used, and instead of the exemplary compound (B-23) of the charge transport material, (B-20), (C-3), (C-16), (D-25) and (E-7) were used. Photoreceptors (10) to (11) were prepared in the same manner as photoreceptor (1), except that the thickness of the charge generation layer was varied. The photoreceptors (5) to (11) were used in Examples 5 to 11.

The drift mobility μ of carrier of each photoconductive layer of the photoreceptors (2) to (11) was measured in the same manner as the photoreceptor (1) using a sample made in the same manner as that of the photoreceptor (1). Results of the measurement were shown in Table 5.

Structure of the charge generation material (A-2):

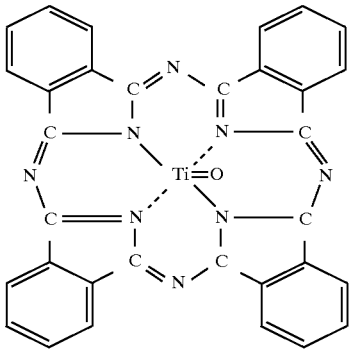

Preparation of Photoreceptor (12) to (16) Photoreceptors (12) to (13) were prepared in the same manner as photoreceptor (1), except that, instead of the exemplary compound (B-23) of the charge transport layer, compounds (Z-1) and (Z-2) of the following structure were used as the charge transport material.

Photoreceptors (14) to (15) were prepared in the same manner as photoreceptor (1), except that, instead of the charge generation material (A-1), the charge generation material (A-2) was used, and (Z-3) and (Z-4) were used as the charge transport material. Photoreceptor (16) was prepared in the same manner as photoreceptor (1), except that the thickness of the charge transport layer was varied. The photoreceptors (12) to (16) were used in Comparative Examples 3 and 4.

The drift mobility $\mu$ of carrier of each photo-conductive layer of the photoreceptors (10) to (13) was measured in the same manner as the photoreceptor (1) using a sample made in the same manner as that of the photoreceptor (1). Results of the measurement were shown in Table 5.

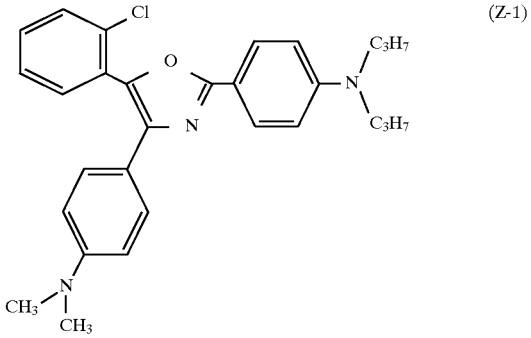

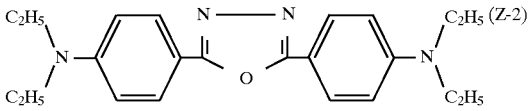

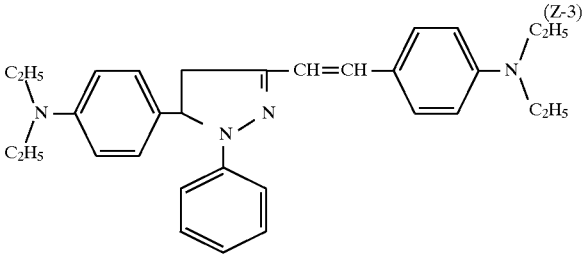

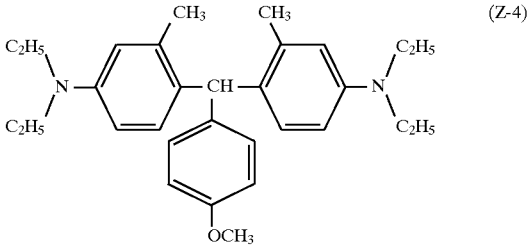

Preparation of Developer

Toner used for development: 100 weight parts of polyester resin "Tatton NEK-2157A" manufactured by Kao Co. and 2 weight parts of low molecular weight polypropylene were mixed, kneaded, cooled, crashed, ground and sieved so as to obtain toner, the average particle size of which was 11 $\mu$m.

In this connection, yellow toner (Y), magenta toner (M), cyan toner (C) and black toner (BK) were respectively made of Y pigment, Pigment yellow 17, M pigment, Pigment red 212, C pigment, Pigment blue 15, and BK pigment, carbon black in accordance with the recipe described before.

Carrier: 1000 weight parts of ferrite particles, the average particle size of which was 52 $\mu$m, and 20 weight parts of methyl methacrylate-styrene (1:1) copolymer resin fine particles were mixed by the high speed agitating mixer. By applying mechanical shocks, the resin fine particles were deposited on the surfaces of the ferrite particles. In this way, magnetic carrier particles, the resin coating layer of which was 0.1 mm thick, were provided.

Developer: 1000 weight parts of carrier and 50 weight parts of toner of each color were respectively mixed, so that 4 types of developers of Y, M, C and BK were provided.

Examples 1 to 11

The aforementioned photoreceptors (1) to (11) were successively assembled into the cartridge 30 of the red LED printer of 400 dpi shown in FIG. 2 so that the photoreceptors (1) to (9) were used as the photoreceptor 10. Developers of Y, M, C and BK were respectively charged into the developing units 13(Y), 13(M), 13(C) and 13(BK). According to the following process condition, color print tests were conducted by 100,000 times using each developing unit.

Using a red LED of GaAsP, exposure was conducted under the condition that the amount of light incident on the photoreceptor was 1.8 $\mu$W. At this time, the image formation process speed of the photoreceptor was set at 75 mm/sec, and the distance from the exposure position (end point of exposure) to the development position (position where the photoreceptor is located closest to the development sleeve) was set at 3 mm in the cases of Examples 1 to 4 and Comparative Examples 1, 2 and 5. The distance was also set at 7 mm in the cases of Examples 5 to 10 and Comparative Examples 3 and 4. The distance was also set at 10 mm in the case of Example 11. In this case, the periods of time necessary for the movement from the image exposure position to the development position are shown in the table.

In this case, the light transmission factor of CGL is defined as a ratio of an amount of light transmitted through CGL to an amount of light (100%) incident on the CGL layer.

Evaluation of the result of printing of Examples 1 to 11

On the cartridge 30 of the red LED printer of 400 dpi illustrated in FIG. 2, the example photoreceptors (1) to (11) and the comparative example photoreceptors (12) to (16) were successively mounted. Then the developing units 13(Y), 13(M), 13(C) and 13(BK) were respectively filled with the developers. Then, under the process conditions described above (image formation process speed was 75 mm/sec, and the distance from the exposing position to the developing position was set as shown on the table), and 100,000 recording sheets of color printing were conducted. Thus obtained color prints were evaluated by the sharpness, the occurrence of blur, and the occurrence of a memory image wherein the memory image is a phenomenon in which the previous image appears on the successive image. Further, the color prints were evaluated by the overall evaluation. In this case, the marks are defined as follows.

⊚: Excellent

○: Good

X: No good

As a result, color images of high quality and excellent color balance were provided as shown in Table 6.

Comparative Examples 1 to 5

In Comparative Examples 1 to 5, the photoreceptors (12) to (16) were subjected to color print tests in the same manner as Example 1. As shown in Table 6, the residual images appeared on the following color images, and color balance was not good, and further color separation was not good.

TABLE 5

| | CGL | CTL | CGL Thickness (μm) | CGL Transmittance (%) | Drift Mobility of Photoreceptor ($cm^2$/V · sec) | Time from Exposure to Development (msec) |
|---|---|---|---|---|---|---|
| Example-1 | A-1 | B-23 | 0.30 | 3.7 | $1.8 \times 10^{-5}$ | 40 |
| Example-2 | A-1 | B-43 | 0.30 | 3.7 | $3.0 \times 10^{-5}$ | 40 |
| Example-3 | A-1 | D-06 | 0.30 | 3.7 | $1.4 \times 10^{-5}$ | 40 |
| Example-4 | A-1 | D-14 | 0.30 | 3.7 | $1.2 \times 10^{-5}$ | 40 |
| Example-5 | A-2 | B-20 | 0.30 | 2 | $4.6 \times 10^{-6}$ | 93 |
| Example-6 | A-2 | C-03 | 0.30 | 2 | $3.1 \times 10^{-6}$ | 93 |
| Example-7 | A-2 | C-16 | 0.30 | 2 | $1.2 \times 10^{-6}$ | 93 |
| Example-8 | A-2 | D-25 | 0.30 | 2 | $5.0 \times 10^{-6}$ | 93 |
| Example-9 | A-2 | E-07 | 0.30 | 2 | $3.2 \times 10^{-6}$ | 93 |
| Example-10 | A-1 | B-23 | 0.23 | 8.0 | $1.8 \times 10^{-5}$ | 93 |
| Example-11 | A-1 | B-23 | 0.17 | 15 | $1.8 \times 10^{-5}$ | 93 |
| Comparative Example-1 | A-1 | Z-01 | 0.30 | 3.7 | $5.6 \times 10^{-7}$ | 40 |
| Comparative Example-2 | A-1 | Z-02 | 0.30 | 3.7 | $1.1 \times 10^{-7}$ | 40 |
| Comparative Example-3 | A-2 | Z-03 | 0.30 | 2 | $7.0 \times 10^{-7}$ | 93 |
| Comparative Example-4 | A-2 | Z-04 | 0.30 | 2 | $8.4 \times 10^{-7}$ | 93 |
| Comparative Example-5 | A-2 | B-23 | 0.13 | 25 | $1.8 \times 10^{-5}$ | 40 |

TABLE 6

| | Sharpness (Resolution of a linear image) | Image blur | After-image caused by memory | Overall evaluation |
|---|---|---|---|---|
| Example-1 | 4 pieces/mm | No | No | ◎ |
| Example-2 | 4 pieces/mm | No | No | ◎ |
| Example-3 | 4 pieces/mm | No | No | ◎ |
| Example-4 | 4 pieces/mm | No | No | ◎ |
| Example-5 | 4 pieces/mm | No | No | ◎ |
| Example-6 | 5 pieces/mm | No | No | ◎ |
| Example-7 | 5 pieces/mm | No | No | ◎ |
| Example-8 | 4 pieces/mm | No | No | ◎ |
| Example-9 | 5 pieces/mm | No | No | ◎ |
| Example-10 | 5 pieces/mm | No | No | ◎ |
| Example-11 | 4 pieces/mm | No | No | ○ |
| Comparative Example-1 | 2 pieces/mm | Occurrence of image blur | Memory image occurred and defective separation of each color image occurred. | x |
| Comparative Example-2 | 3 pieces/mm | Occurrence of image blur | Memory image occurred and defective separation of each color image occurred. | x |
| Comparative Example-3 | 2 pieces/mm | Occurrence of image blur | Memory image occurred and defective separation of each color image occurred. | x |
| Comparative Example-4 | 2 pieces/mm | Occurrence of image blur | Memory image occurred and defective separation of each color image occurred. | x |
| Comparative Example-5 | 3 pieces/mm | Occurrence of image blur | No | x |

What is claimed is:

1. An electrophotographic photoreceptor comprising a transparent support provided thereon a transparent layer, a charge carrier generation layer and a charge carrier transport layer, wherein a transmittance of said charge carrier generation layer is 20% or less, and a carrier drift mobility of said charge carrier transport layer is $1\times10^{-6}$ $cm^2$/V sec or more under an electric field intensity of $2\times10^5$ V/cm.

2. The photoreceptor of claim 1, wherein on the support, the transparent layer, charge carrier generation layer and charge carrier transport layer are provided in this order.

3. The photoreceptor of claim 1, wherein a transmittance of said support is not less than 80%.

4. The photoreceptor of claim 3, wherein said support is comprised of a glass, a urethane rubber or a plastic material selected from the group consisting of a polycarbonate, polyethylene terephthalate, polystyrene, polyimide, polyamide and cellulose acetate.

5. The photoreceptor of claim 1, wherein said transparent layer is electrically conductive, comprising (a) a metal oxide selected from the group consisting of ITO, $SnO_2$ $In_2O_3$ and alumite, (b) a metal, or (c) an alloy of said metal, said metal being selected from the group consisting of Al, Au, Ag, Cu, Ni, Ti, Zn, Cr, In, Sn, Pb, and Fe.

6. The photoreceptor of claim 5, wherein said transparent layer has a thickness of 100 Å to 5 μm.

7. The photoreceptor of claim 5, wherein said transparent layer has a surface resistance of not more than $10^8$ Ω.

8. The photoreceptor of claim 7, wherein said transparent layer has a surface resistance of not more than $10^6$ Ω.

9. The photoreceptor of claim 1, wherein said charge carrier transport layer comprises a charge carrier transport material selected from the group consisting of compounds represented by the following formulas I through IV:

formula I

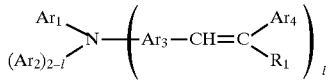

wherein $Ar_1$, $Ar_2$, $Ar_3$ and $Ar_4$ independently represent an aromatic hydrocarbon group or a heterocyclic group; $R_1$ represents a hydrogen atom, an aromatic hydrocarbon group or a heterocyclic group; l is 1 or 2;

formula II

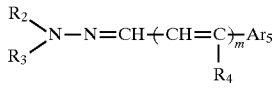

wherein $R_2$ and $R_3$ independently represent an aromatic hydrocarbon group, a heterocyclic group or an alkyl group; $R_4$ represents a hydrogen atom, an aromatic hydrocarbon group, a heterocyclic group or an alkyl group; $Ar_5$ represents an aromatic hydrocarbon group or a heterocyclic group; m is 0 or 1;

formula III

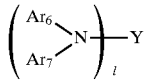

wherein Y represents a monovalent, divalent or trivalent aromatic group; $Ar_6$ and $Ar_7$ independently represent an aromatic hydrocarbon group or a heterocyclic group; l is an integer of 1 to 3;

formula IV

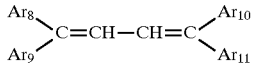

wherein $Ar_8$, $Ar_9$, $Ar_{10}$ and $Ar_{11}$ independently represent an aromatic hydrocarbon group or a heterocyclic group.

10. The photoreceptor of claim 1, wherein said charge carrier generation layer comprises a charge carrier generation material selected from the group consisting of compounds represented by the following formulas V and VI:

formula V

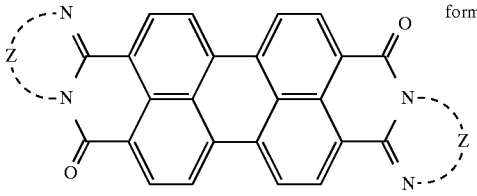

formula VI

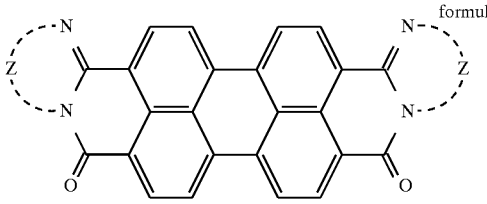

wherein Z represents a group of atoms necessary for forming an aromatic ring.

11. The photoreceptor of claim 1, wherein said charge carrier generation layer comprises a charge carrier generation material represented by the following formula VII, said charge carrier generation material having a peak at Bragg angle of 2 θ of 27.3±0.2° with respect to Cu K α characteristic X ray at a wavelength of 1.541 Å formula VII

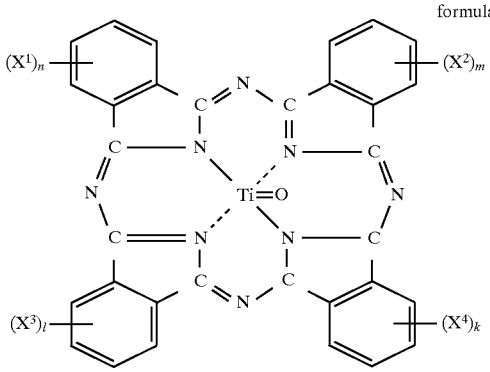

wherein $X^1$, $X^2$, $X^3$ and $X^4$ independently represent Br, Cl or F; k, l, m and n each are an integer of 0 to 4.

12. The photoreceptor of claim 11, wherein said charge carrier generation material further has a peak at Bragg angle 2 θ of 9.0±0.2° or 9.5±0.2°.

13. The photoreceptor of claim 1, wherein said charge carrier generation layer comprises a binder resin and a charge carrier generation material in a ratio by weight of the binder resin to the charge carrier generation material is 0 to 10, said charge carrier generation layer having a thickness of 0.01 to 10 μm.

14. The photoreceptor of claim 1, wherein the transmittance of said charge carrier generation layer is 10% or less.

15. The photoreceptor of claim 1, wherein said photoreceptor is exposed to light from the side of said transparent support.

16. An electrophotographic photoreceptor comprising a transparent support provided thereon a transparent layer, a charge carrier generation layer and a charge carrier transport layer, wherein said photoreceptor is exposed to light from the side of the support, said support having a transmittance of not less than 80% with respect to exposing light, and wherein a transmittance of said charge carrier generation layer is 20% or less, and a carrier drift mobility of said charge carrier transport layer is $1\times10^{-6}$ $cm^2/V$ sec or more under an electric field intensity of $2\times10^5$ V/cm, said charge carrier generation layer comprising a charge carrier generation material represented by the following formula VII, and said charge carrier generation material having a peak at Bragg angle of 2 θ of 27.3±0.2° with respect to Cu K α characteristic X ray at a wavelength of 1.541 Å formula VII

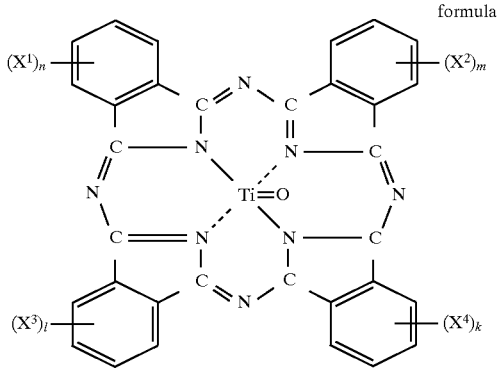

wherein $X^1$, $X^2$, $X^3$ and $X^4$ independently represent Br, Cl or F; k, l, m and n each are an integer of 0 to 4.

* * * * *